US010203658B2

(12) United States Patent
Sakai et al.

(10) Patent No.: US 10,203,658 B2
(45) Date of Patent: Feb. 12, 2019

(54) IMAGE FORMING APPARATUS HAVING ELECTRICAL CONTACT

(71) Applicant: Brother Kogyo Kabushiki Kaisha, Nagoya-shi, Aichi-ken (JP)

(72) Inventors: Ryosuke Sakai, Nagoya (JP); Junichi Yokoi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/467,519

(22) Filed: Mar. 23, 2017

(65) Prior Publication Data

US 2017/0277119 A1 Sep. 28, 2017

(30) Foreign Application Priority Data

Mar. 25, 2016 (JP) ..... 2016-060998
Mar. 31, 2016 (JP) ..... 2016/070812
Mar. 31, 2016 (JP) ..... 2016-070813
Mar. 31, 2016 (JP) ..... 2016/070814
Mar. 31, 2016 (JP) ..... 2016-070815
(Continued)

(51) Int. Cl.
*G03G 21/00* (2006.01)
*G03G 21/18* (2006.01)
*G03G 21/16* (2006.01)

(52) U.S. Cl.
CPC ..... *G03G 21/1867* (2013.01); *G03G 21/1633* (2013.01); *G03G 21/1652* (2013.01);
(Continued)

(58) Field of Classification Search
CPC ..... G03G 15/04054; G03G 15/80; G03G 21/1878; G03G 21/1885; G03G 21/1633;
(Continued)

(56) References Cited

U.S. PATENT DOCUMENTS 7,826,768 B2 * 11/2010 Ishikawa ..... G03G 21/1885 399/107
7,907,865 B2 * 3/2011 Ukai ..... G03G 21/1867 399/110
(Continued)

FOREIGN PATENT DOCUMENTS

CN 204374614 U 6/2015
JP 08142445 A * 6/1996
(Continued)

*Primary Examiner* — Robert Beatty
(74) *Attorney, Agent, or Firm* — Banner & Witcoff, Ltd.

(57) ABSTRACT

An image forming apparatus has a main casing including an opening provided at an upper portion of the main casing, a process cartridge attachable to the main casing through the opening, and a top cover movable between an open position where the top cover opens the opening and a close position where the top cover closes the opening. The process cartridge includes a photosensitive drum and a memory provided with a first electrical contact. The top cover supports an LED head configured to emit light to expose the photosensitive drum, and a second electrical contact electrically connected to the first electrical contact in a state where the process cartridge is attached to the main casing and in a state where the top cover is positioned at the close position.

17 Claims, 29 Drawing Sheets

(30) Foreign Application Priority Data

Mar. 31, 2016 (JP) ..... 2016-070816
Mar. 31, 2016 (JP) ..... 2016-070817

(52) U.S. Cl.
CPC . *G03G 21/1885* (2013.01); *G03G 2215/0141* (2013.01); *G03G 2221/166* (2013.01); *G03G 2221/1823* (2013.01)

(58) Field of Classification Search
CPC ..... G03G 21/1652; G03G 21/1867; G03G 2215/0409; G03G 2221/166; G03G 2221/1823; G06K 15/1247; G06K 15/1261
USPC ..... 399/90, 111; 347/117, 118, 129, 130
See application file for complete search history.

(56) References Cited

U.S. PATENT DOCUMENTS

| | | | | |
|---|---|---|---|---|
| 7,941,061 | B2 | 5/2011 | Kadowaki | |
| 8,405,844 | B2 | 3/2013 | Naruse | |
| 9,146,530 | B2 | 9/2015 | Seto et al. | |
| 9,207,630 | B2 | 12/2015 | Eto | |
| 9,229,425 | B2 | 1/2016 | Wakimoto | |
| 9,323,214 | B2 | 4/2016 | Itabashi et al. | |
| 2003/0215257 | A1 | 11/2003 | Karakama et al. | |
| 2008/0317479 | A1 | 12/2008 | Kadowaki | |
| 2010/0054813 | A1* | 3/2010 | Tamaru | G03G 15/04054 399/205 |
| 2010/0073704 | A1 | 3/2010 | Naruse | |
| 2010/0238259 | A1* | 9/2010 | Naruse | B41J 2/45 347/224 |
| 2011/0064457 | A1 | 3/2011 | Okabe et al. | |
| 2013/0051849 | A1 | 2/2013 | Itabashi et al. | |
| 2014/0169824 | A1 | 6/2014 | Seto et al. | |
| 2014/0348533 | A1 | 11/2014 | Eto | |
| 2015/0212482 | A1 | 7/2015 | Wakimoto | |
| 2015/0277363 | A1 | 10/2015 | Okabe et al. | |

FOREIGN PATENT DOCUMENTS

| | | | | | |
|---|---|---|---|---|---|
| JP | 2001034144 | A | * | 2/2001 | |
| JP | 2002-072826 | A | | 3/2002 | |
| JP | 2003195723 | A | * | 7/2003 | |
| JP | 2004-045857 | A | | 2/2004 | |
| JP | 2004-061596 | A | | 2/2004 | |
| JP | 2004069944 | A | * | 3/2004 | |
| JP | 2006113521 | A | * | 4/2006 | G03G 21/1853 |
| JP | 2008-257124 | A | | 10/2008 | |
| JP | 2009-003099 | A | | 1/2009 | |
| JP | 2010-078799 | A | | 4/2010 | |
| JP | 2010-175626 | A | | 8/2010 | |
| JP | 2011-059510 | A | | 3/2011 | |
| JP | 2011242417 | A | * | 12/2011 | |
| JP | 2012-234190 | A | | 11/2012 | |
| JP | 2013-054058 | A | | 3/2013 | |
| JP | 2014-119505 | A | | 6/2014 | |
| JP | 2014-228608 | A | | 12/2014 | |
| JP | 2015-138246 | A | | 7/2015 | |

* cited by examiner

1

IMAGE FORMING APPARATUS HAVING ELECTRICAL CONTACT

CROSS-REFERENCE TO RELATED APPLICATIONS

This application claims priority under 35 U.S.C. § 119 from Japanese Patent Applications No. 2016-070812, No. 2016-070813, No. 2016-070814, No. 2016-070815, No. 2016-070816 and No. 2016-070817, filed on Mar. 31, 2016, and No. 2016-060998, filed on Mar. 25, 2016. The entire subject matter of the applications is incorporated herein by reference.

BACKGROUND

Technical Field

The present disclosures relate to an image forming apparatus having an electrical contact.

Related Art

There has been known an image forming apparatus which has a main casing formed with an opening, a top cover configured to open/close the opening formed on the main casing, a process cartridge, which contains photosensitive drums and is detachably coupled to the main casing through the opening formed on the main casing, and an LED (light emitting diode) head provided to the top cover and configured to emit light to the photosensitive drums.

SUMMARY

In the conventional image forming apparatus as mentioned above may further be configured such that an IC chip is provided to the process cartridge and information stored in the IC chip may be retrieved in a state where the process cartridge is attached to the main casing.

In such a configuration of the conventional image forming apparatus, it is sometimes difficult to provide an electrical contact, which is to be electrically connected to an electrical contact of the IC chip, on the main casing.

According to aspects of the disclosures, there is provided an image forming apparatus having a main casing, a process cartridge, and a top cover. The main casing has an opening. The opening is provided at an upper portion of the main casing. The process cartridge has a photosensitive drum. The process cartridge is attachable to the main casing through the opening. The process cartridge has a memory. The memory has a first electrical contact. The top cover is movable between an open position where the top cover opens the opening and a close position where the top cover closes the opening. The top cover supports a LED head. The LED head is configured to emit light to expose the photosensitive drum. The top cover supports a second electrical contact. The second electrical contact is electrically connected to the first electrically contact of the memory in a state where the process cartridge is attached to the main casing and in a state where the top cover is positioned at the close position.

According to the above configuration, it is possible to that the main body reads information from a memory of the process cartridge even if it is difficult to provide the electrical contact on the main casing.

BRIEF DESCRIPTION OF THE ACCOMPANYING DRAWINGS

Figure 4:
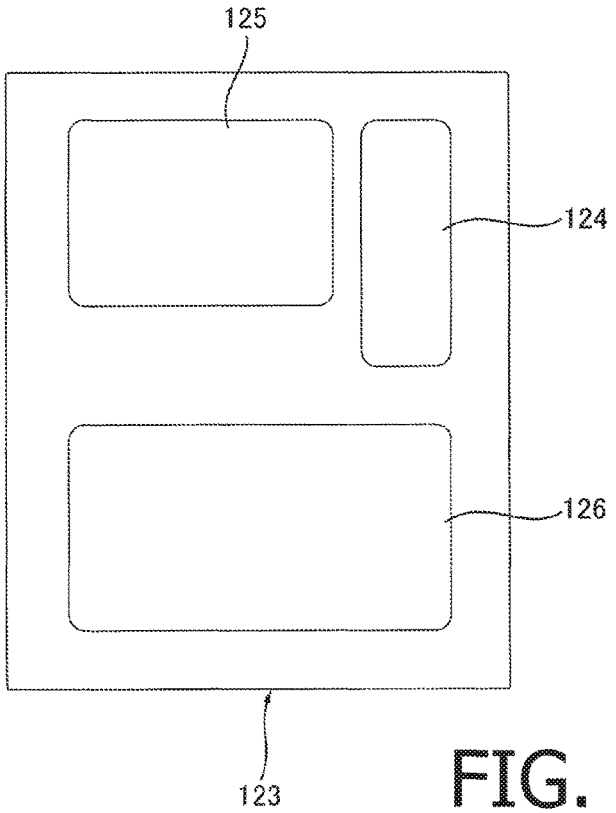

FIG. 4 schematically shows a configuration of a circuit board of the image forming apparatus.

Figure 5:
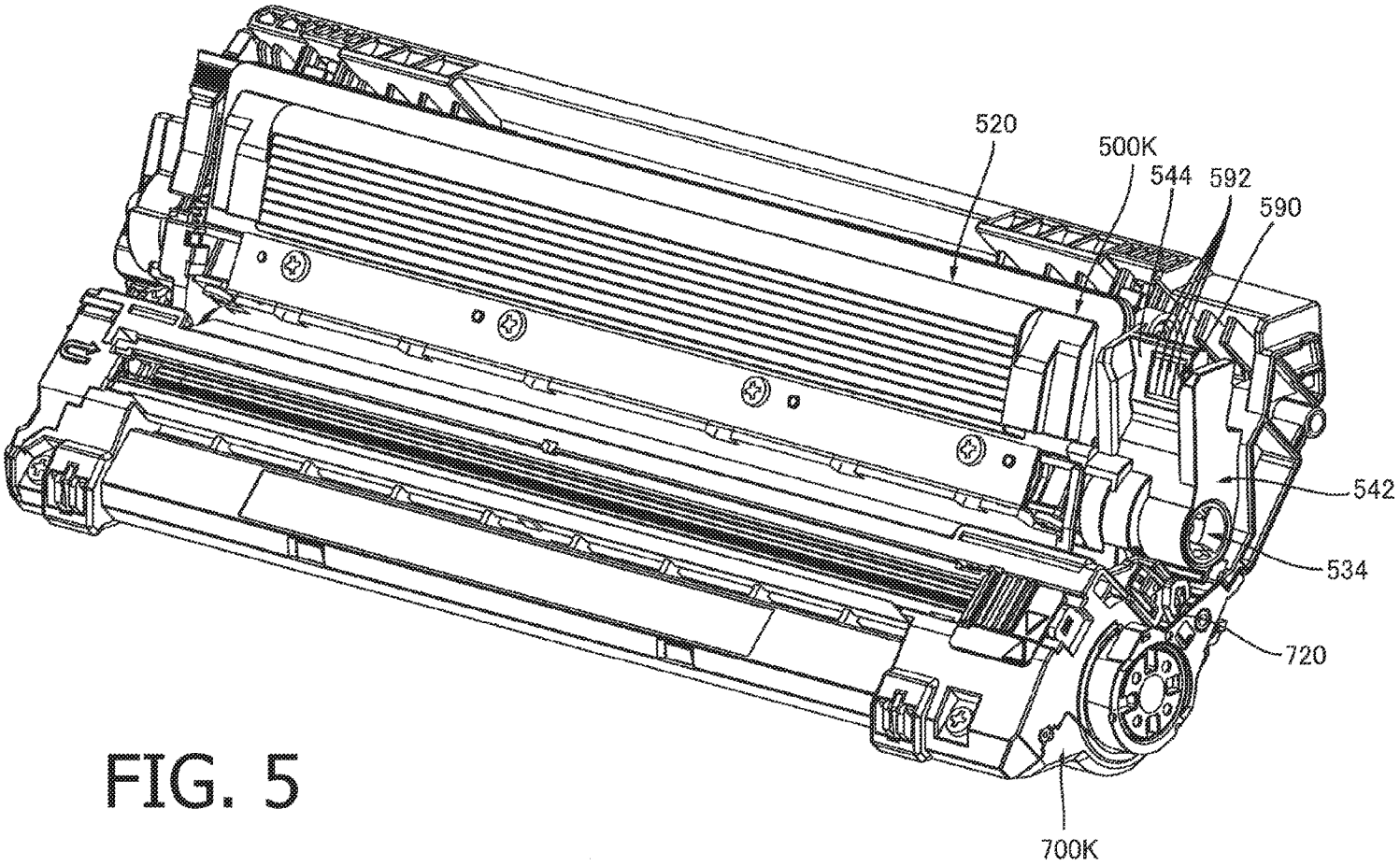

FIG. 5 is a perspective view of a process cartridge of the image forming apparatus.

Figure 6:
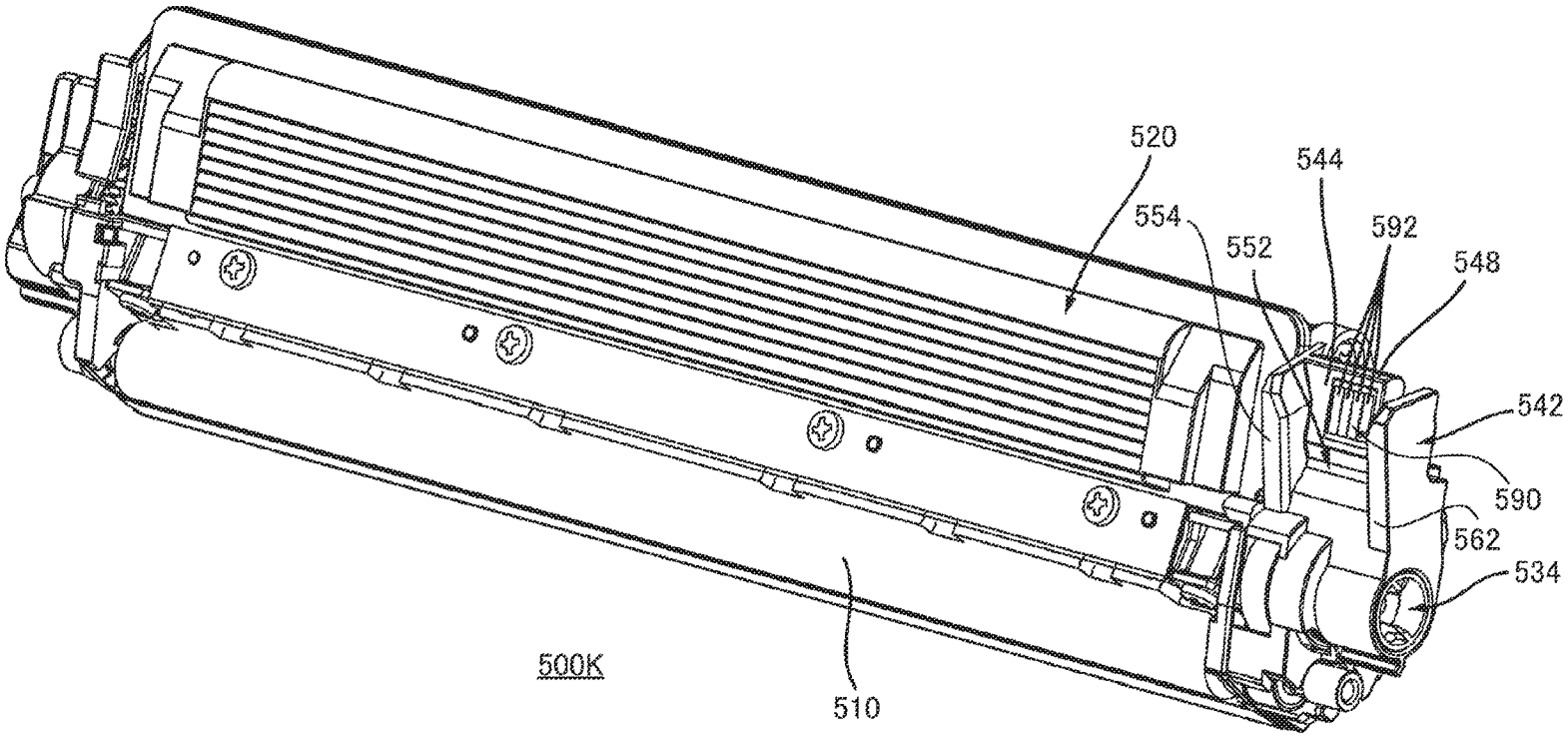

FIG. 6 is a perspective view of a developing cartridge of the image forming apparatus.

Figure 7:
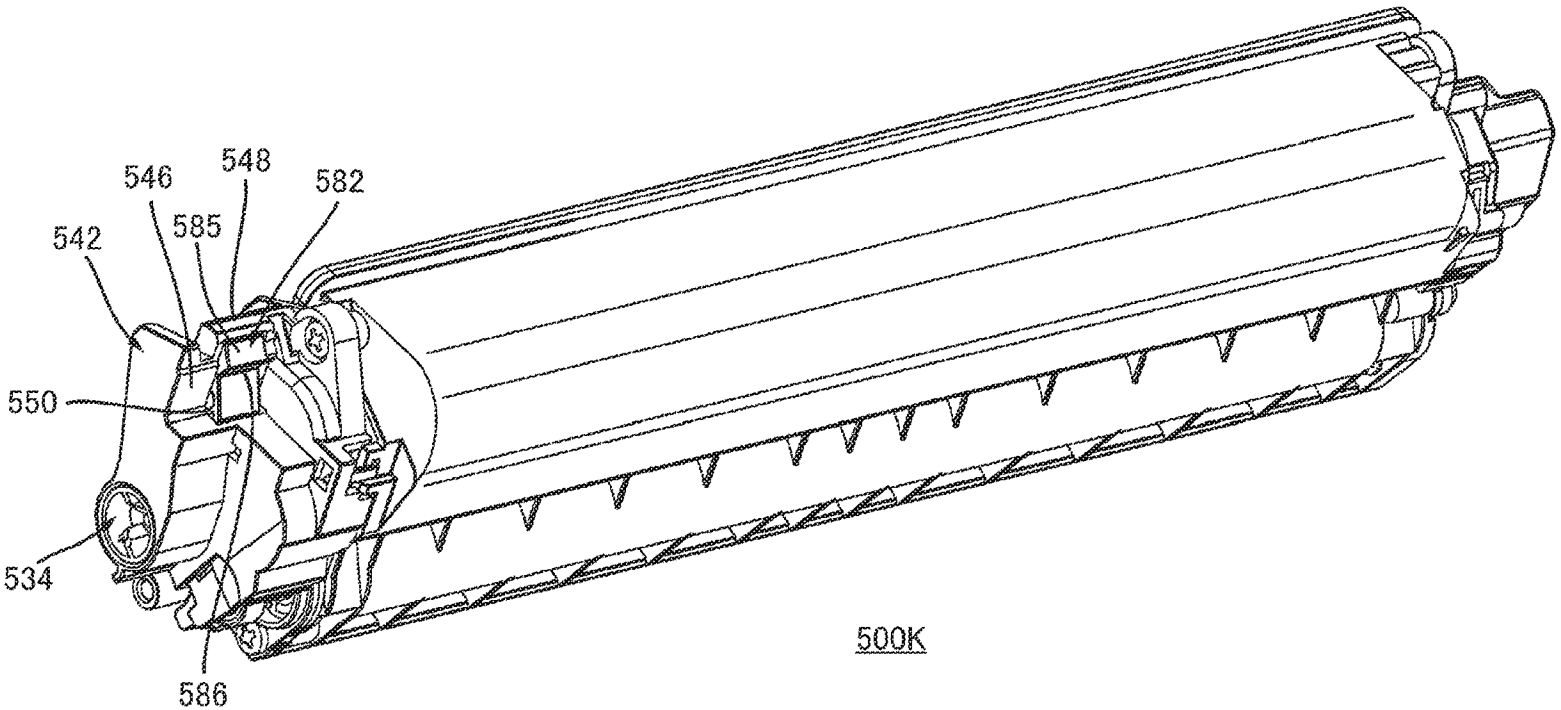

FIG. 7 is another perspective view of the developing cartridge of the image forming apparatus.

Figure 8:
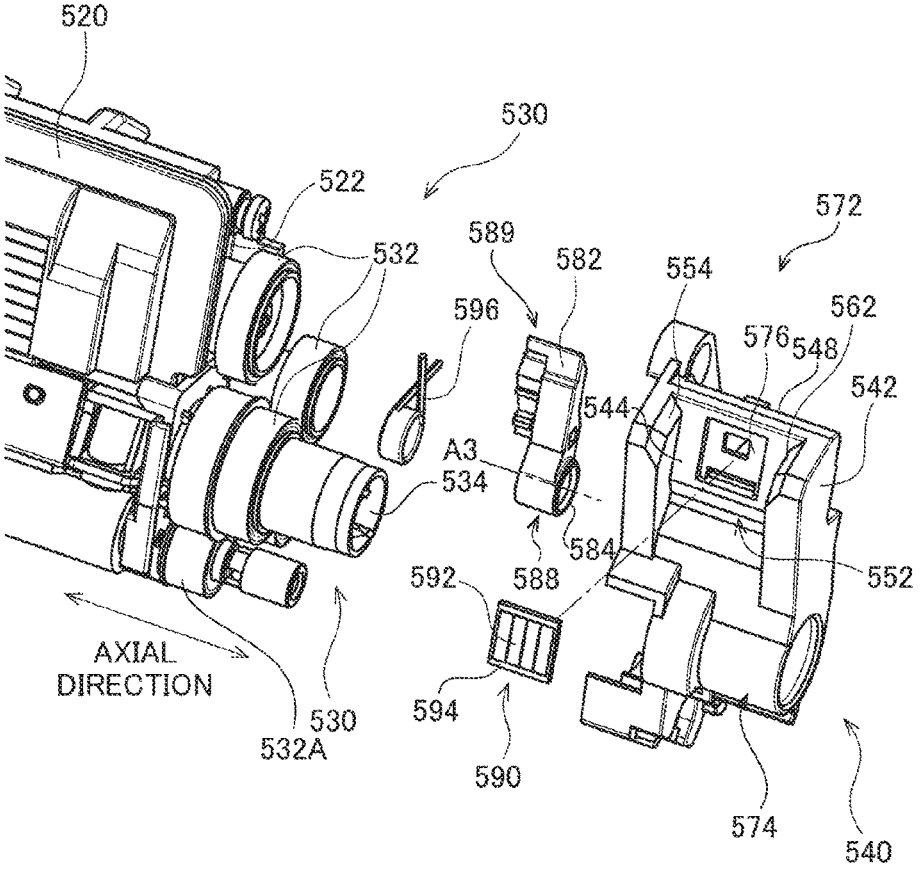

FIG. 8 is an exploded perspective view of the developing cartridge.

Figure 9:
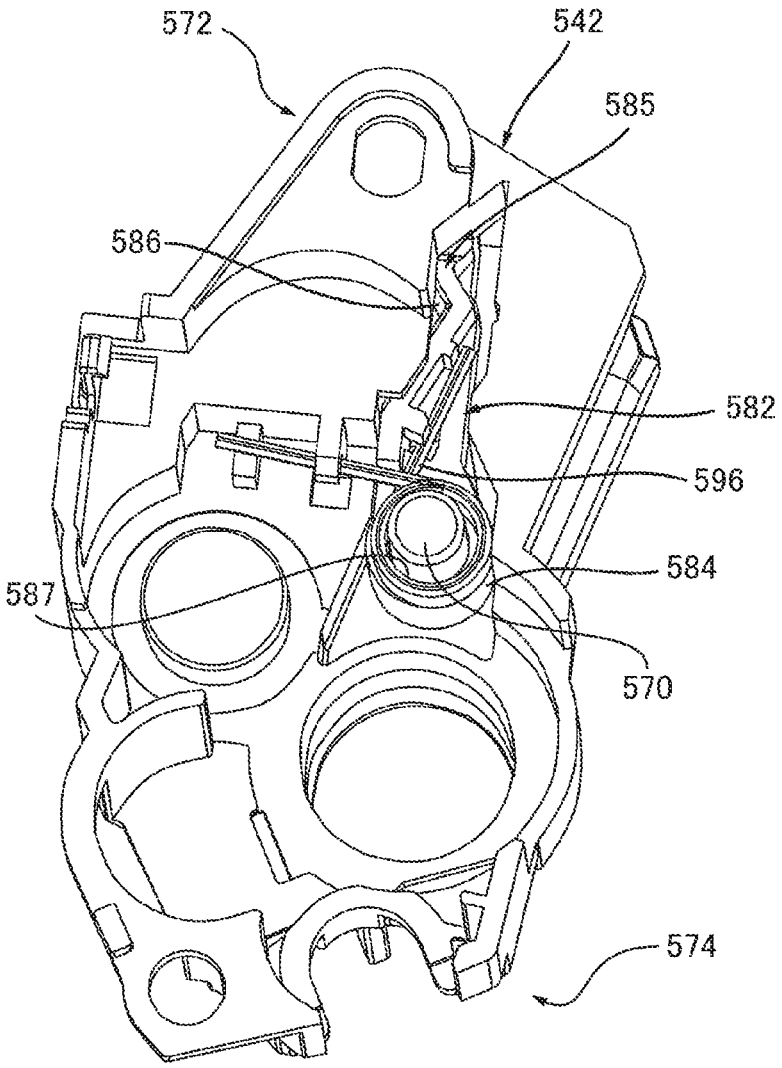

FIG. 9 is a perspective view showing a condition where a sub holder of the developing cartridge is attached to a main holder of the developing cartridge according to the illustrative embodiment.

Figure 10:
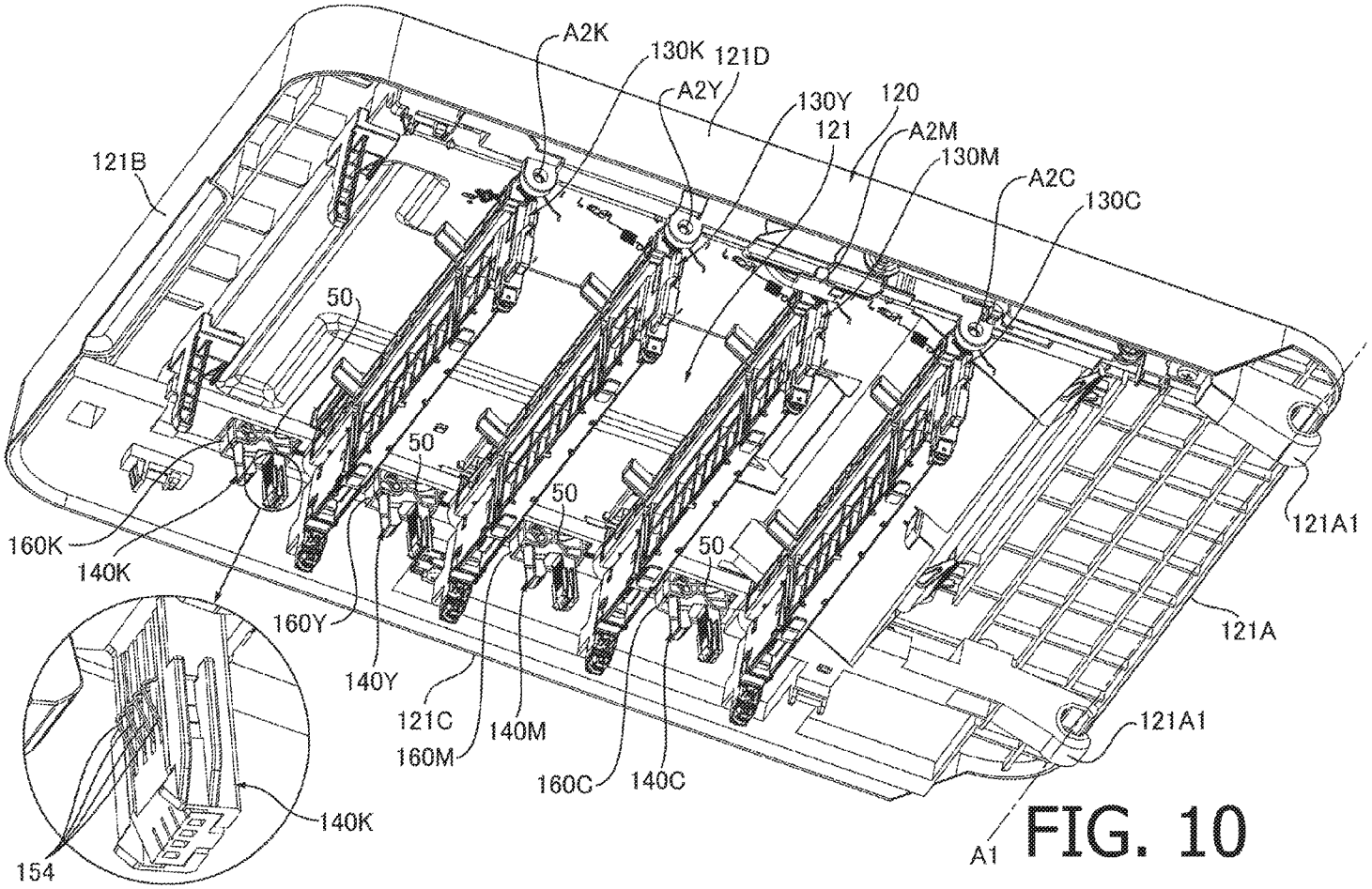

FIG. 10 is a perspective view of a top cover of the image forming apparatus.

Figure 11A:
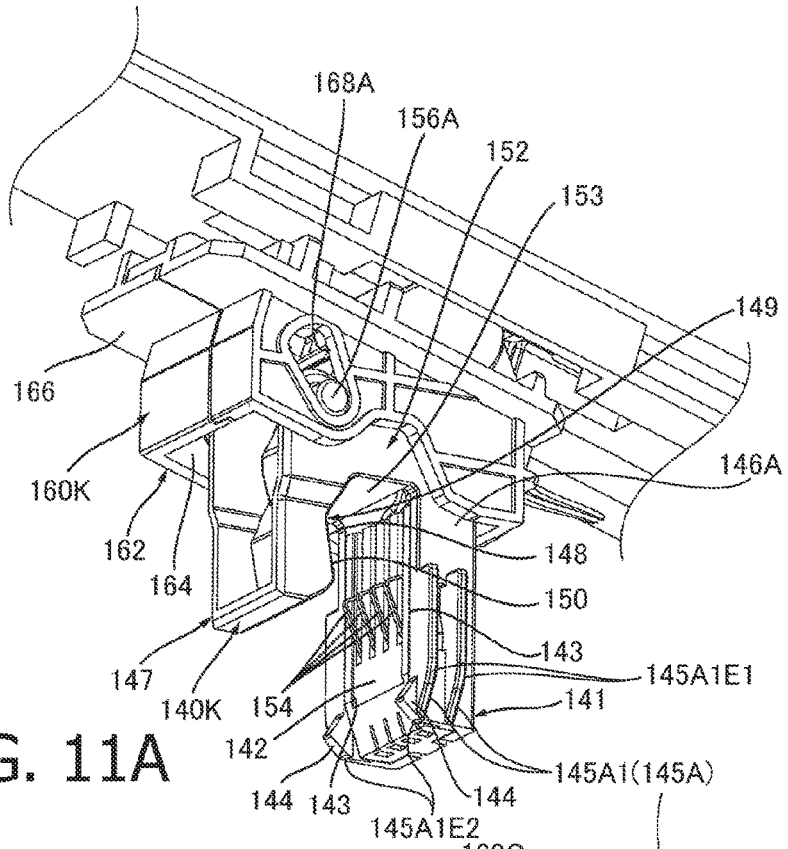

FIG. 11A is a perspective view showing a state where a connector is attached to a connector holder.

Figure 11B:
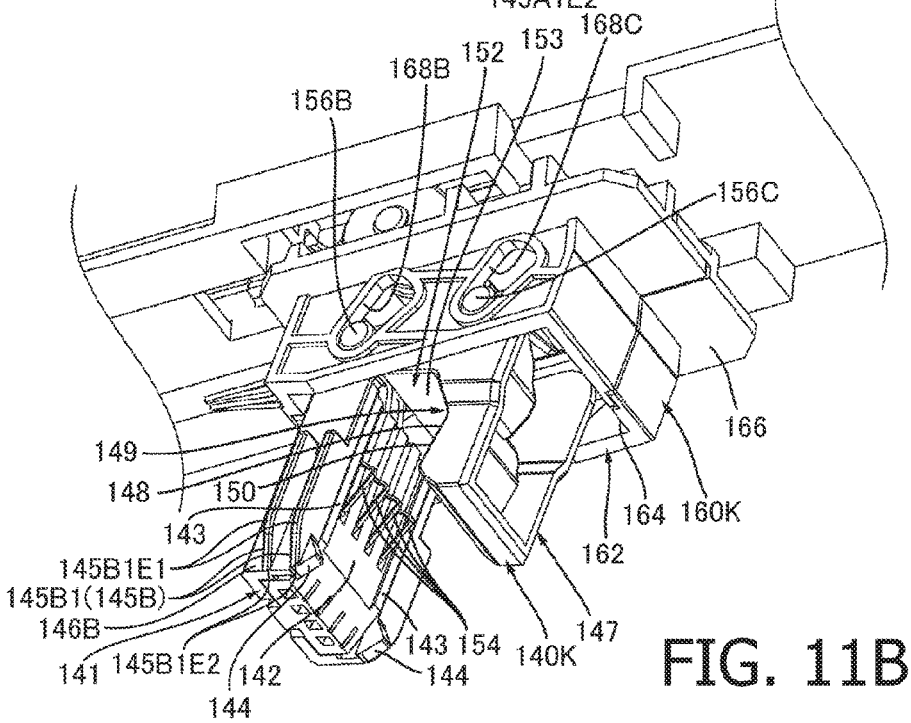

FIG. 11B is another perspective view showing a state where the connector is attached to the connector holder.

Figure 12:
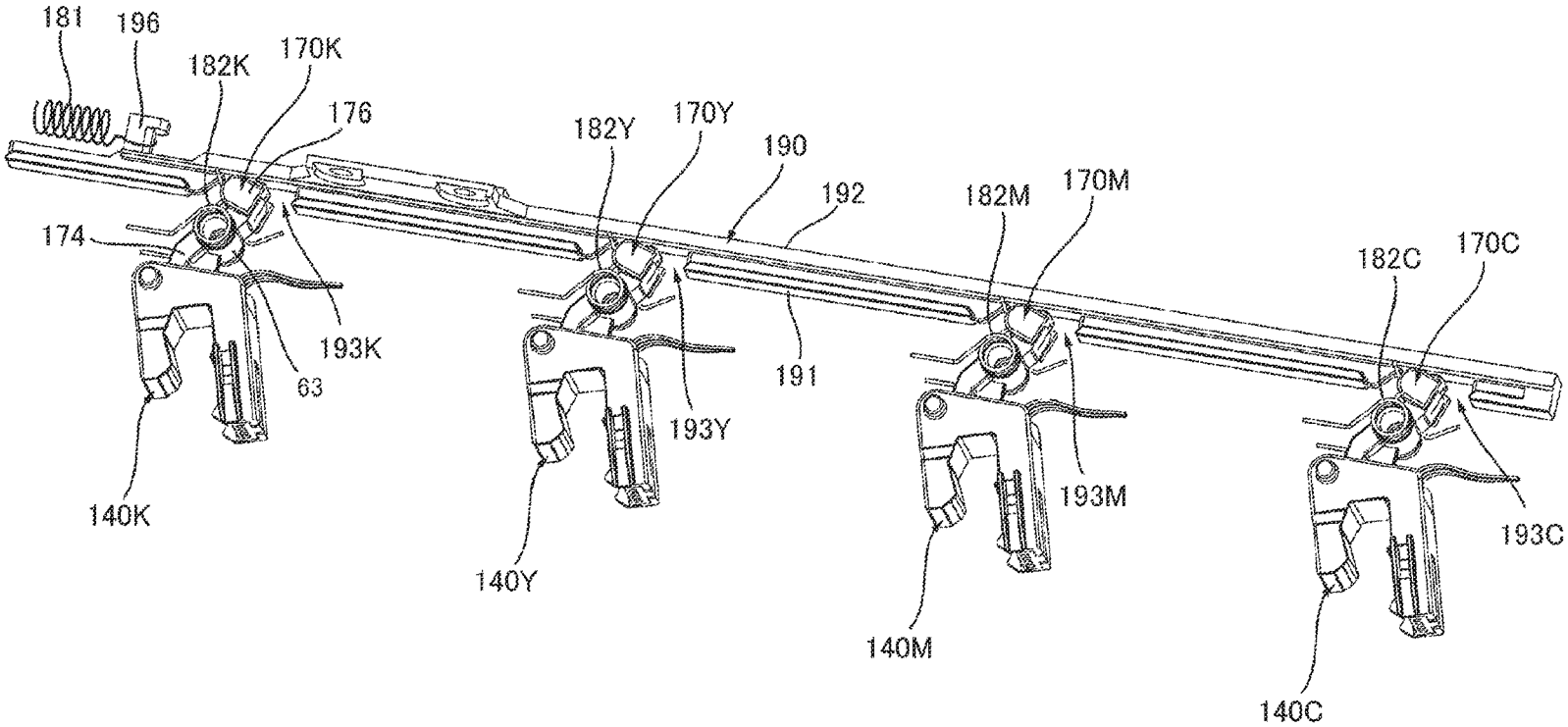

FIG. 12 is a perspective view showing the connector, a pressing member and a first cam.

Figure 13:
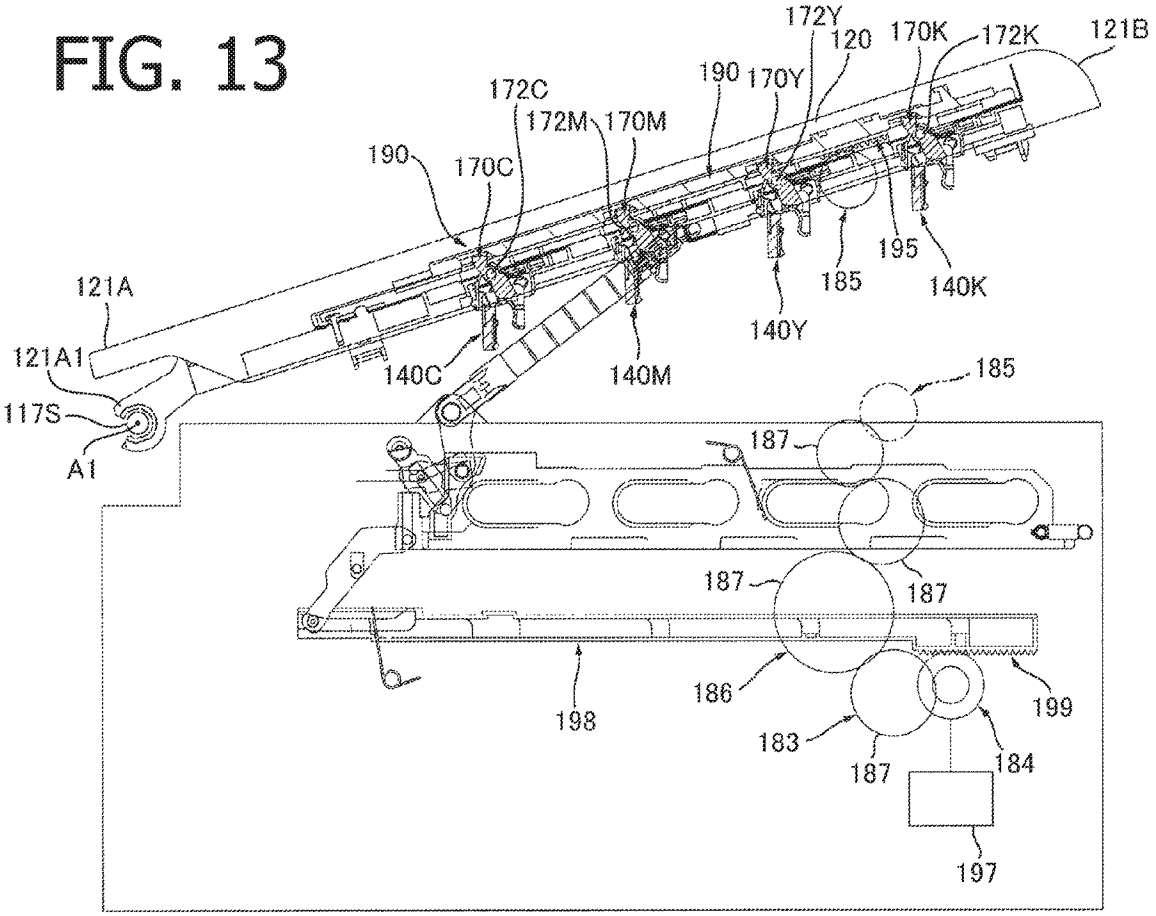

FIG. 13 illustrates a pressing mechanism and a separating mechanism.

Figure 14:
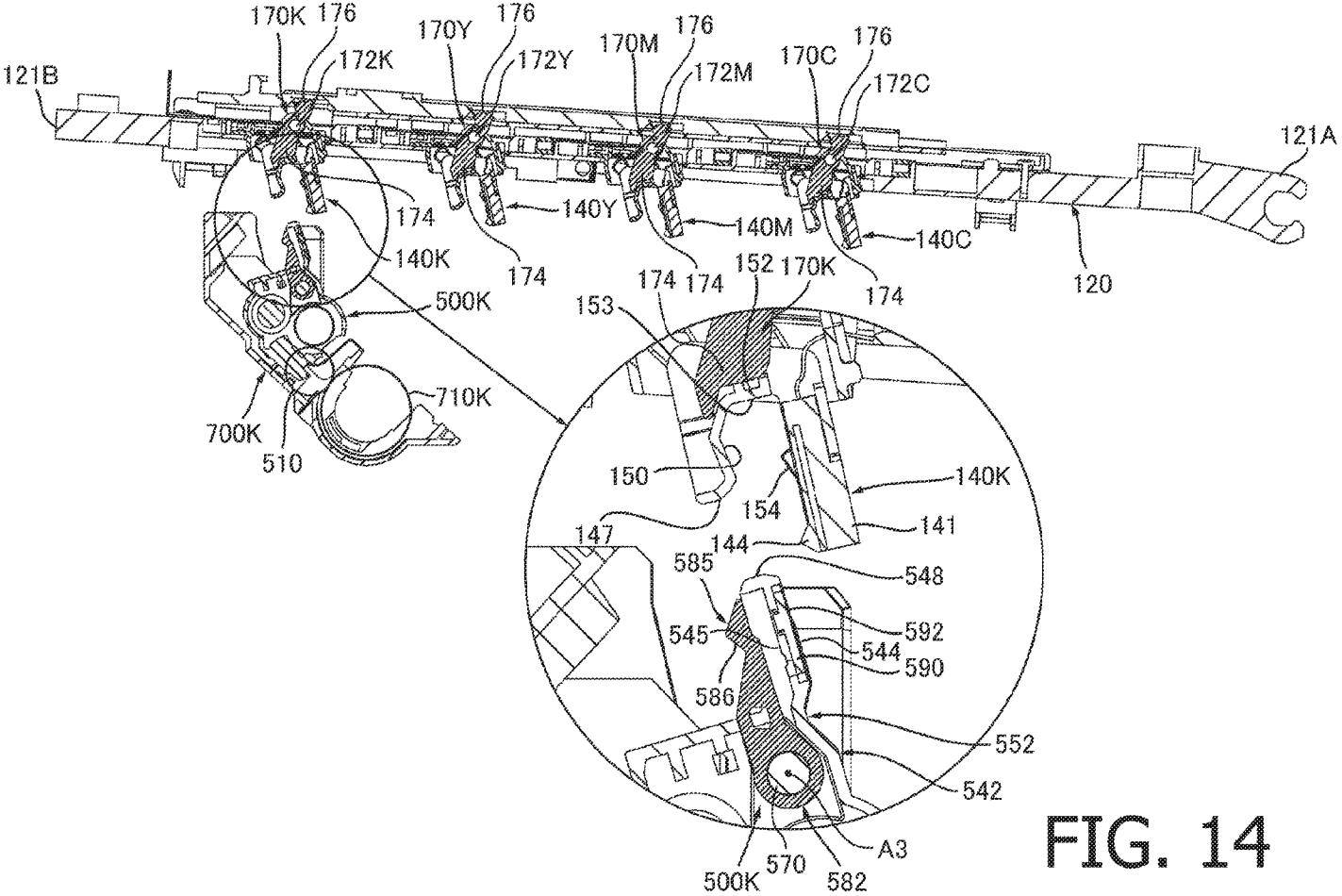

FIG. 14 illustrates movement of the connector with respect to a holder of the developing cartridge.

Figure 15:
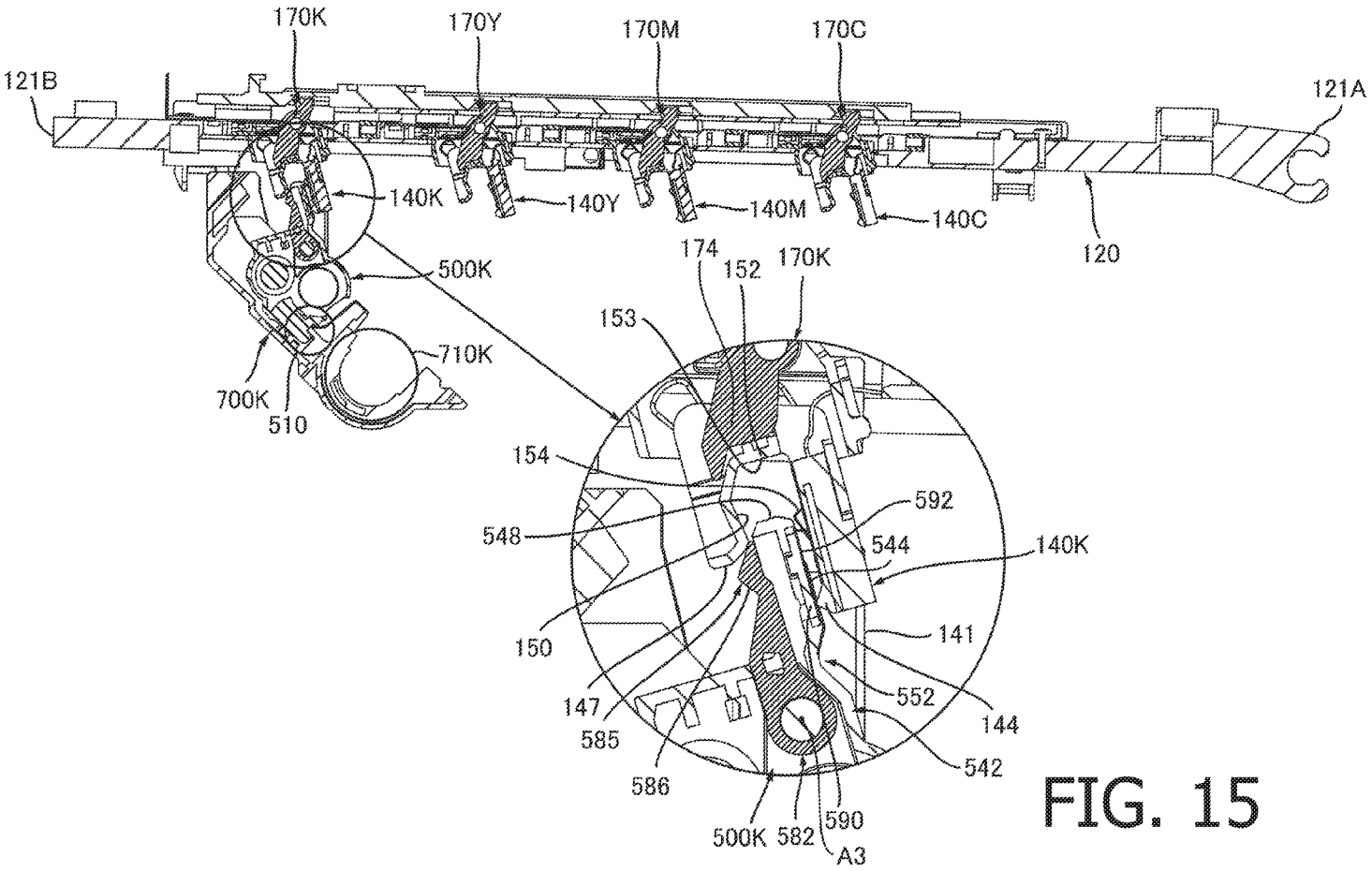

FIG. 15 also illustrates movement of the connector with respect to the holder of the developing cartridge.

Figure 16:
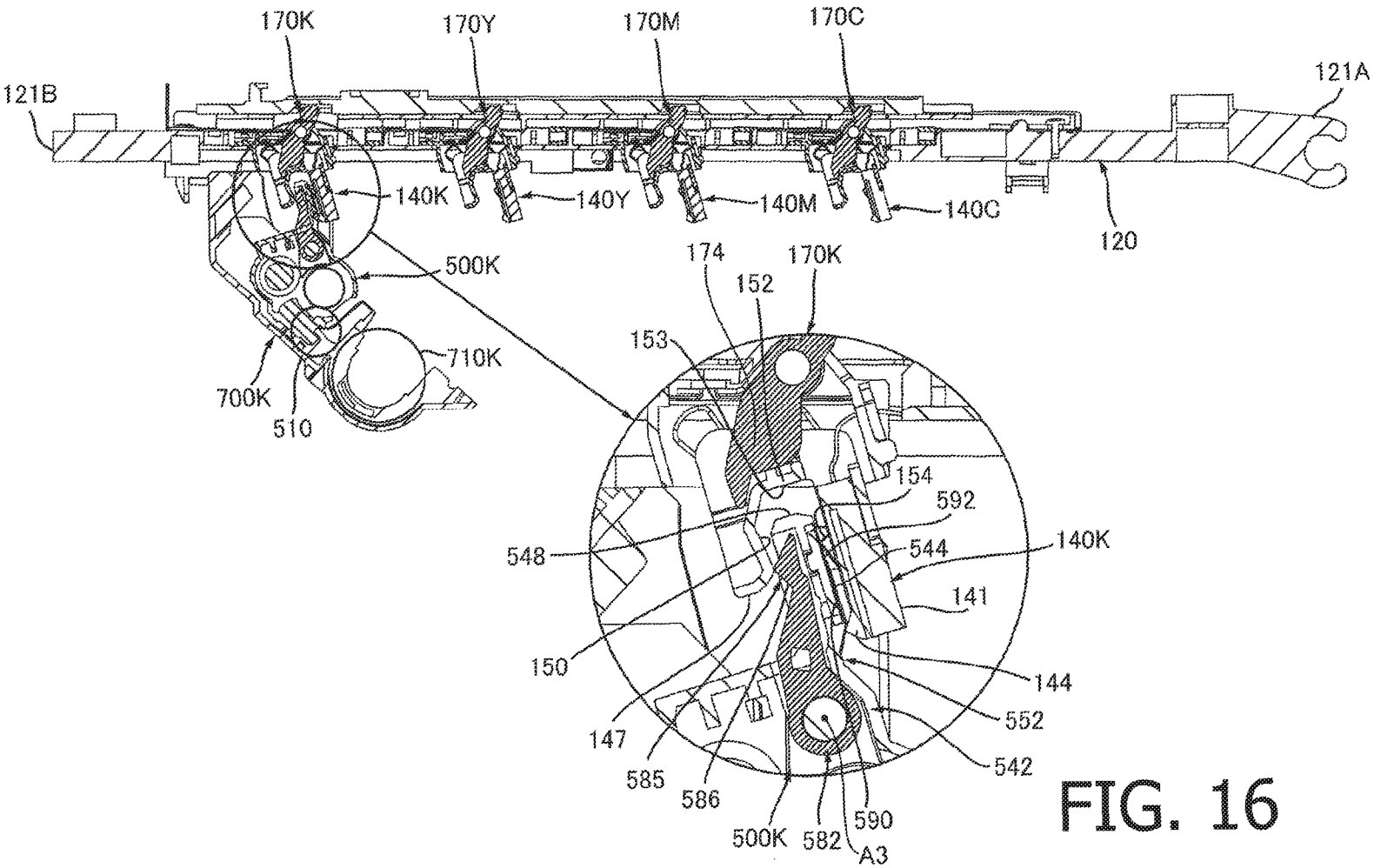

FIG. 16 also illustrates movement of the connector with respect to the holder of the developing cartridge.

Figure 17:
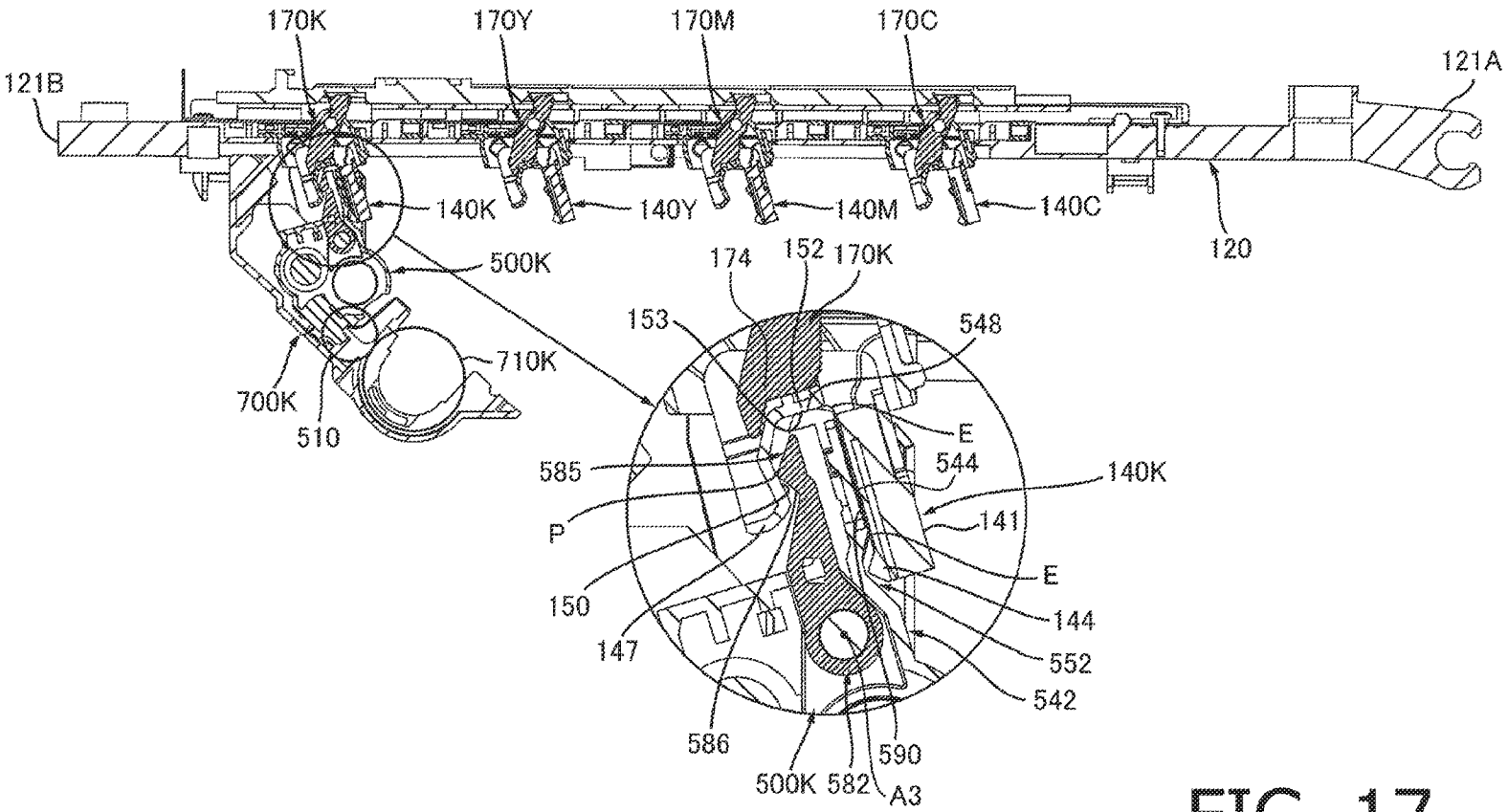

FIG. 17 also illustrates movement of the connector with respect to the holder of the developing cartridge.

Figure 18:
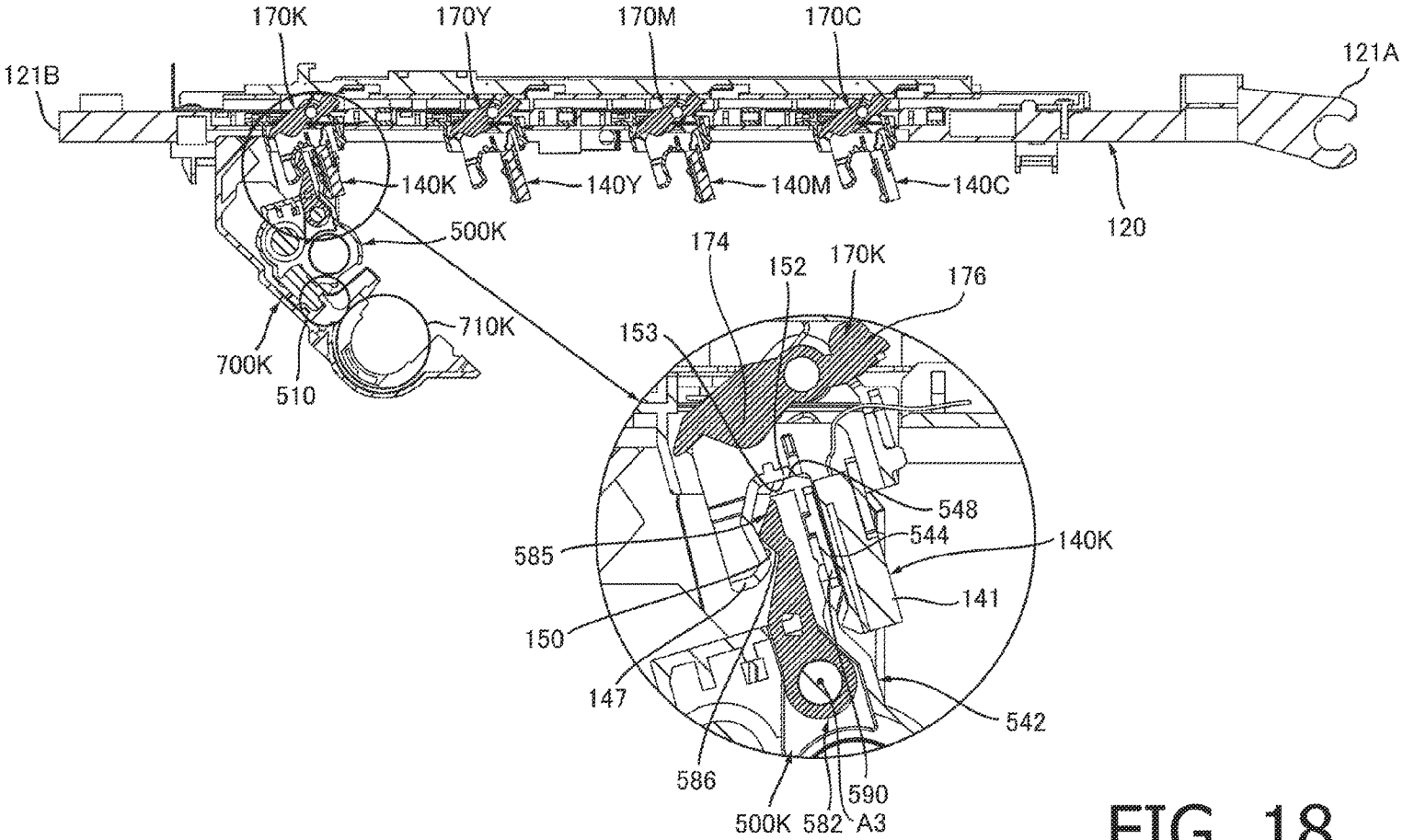

FIG. 18 illustrates approaching/separating movement of the developing cartridge in a state where the pressing member is located at a pressure releasing position and the developing roller contacts the photosensitive drum.

Figure 19:
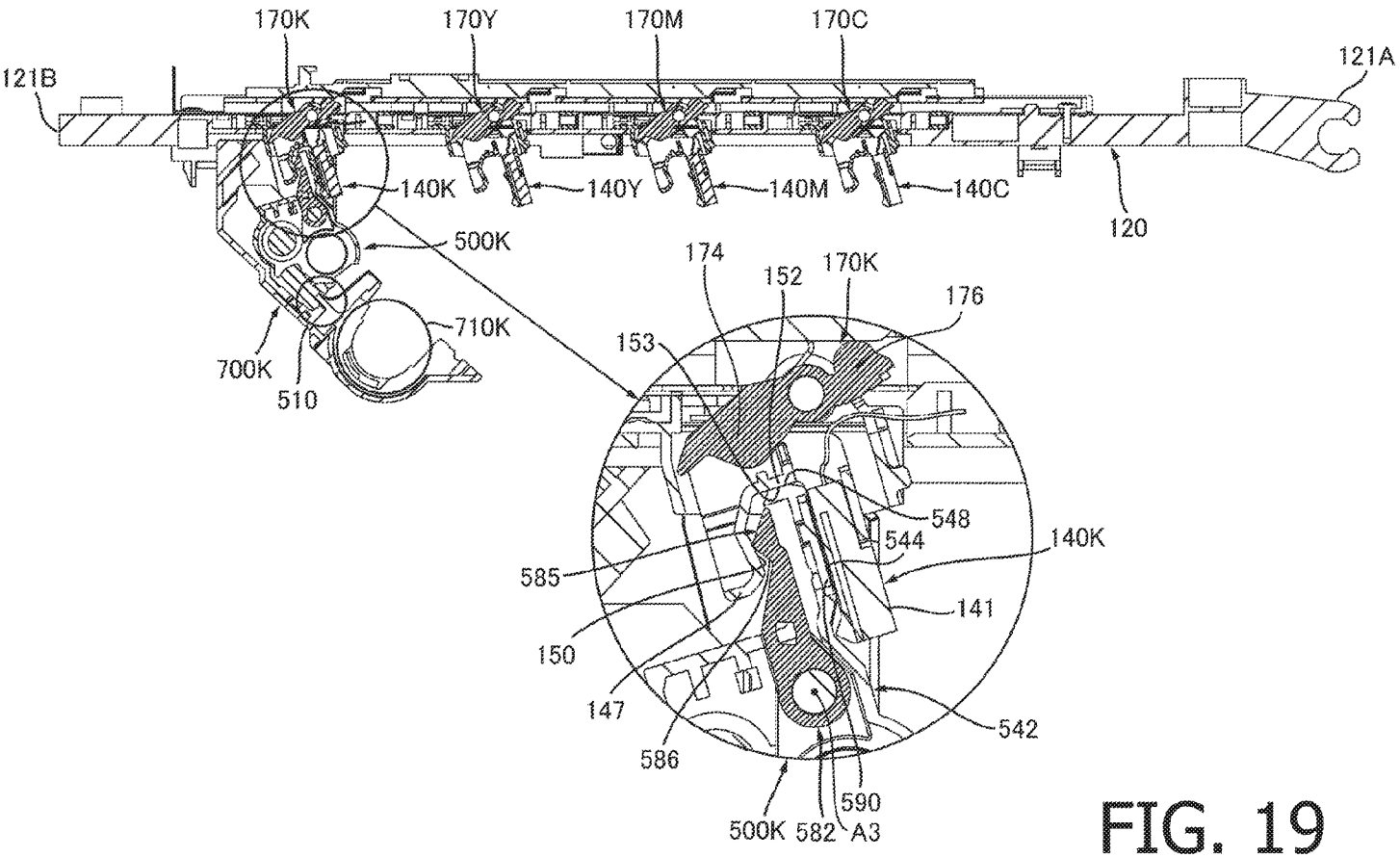

FIG. 19 illustrates approaching/separating movement of the developing cartridge in a state where the pressing member is located at a pressure releasing position and the developing roller is separated from the photosensitive drum.

Figure 20:
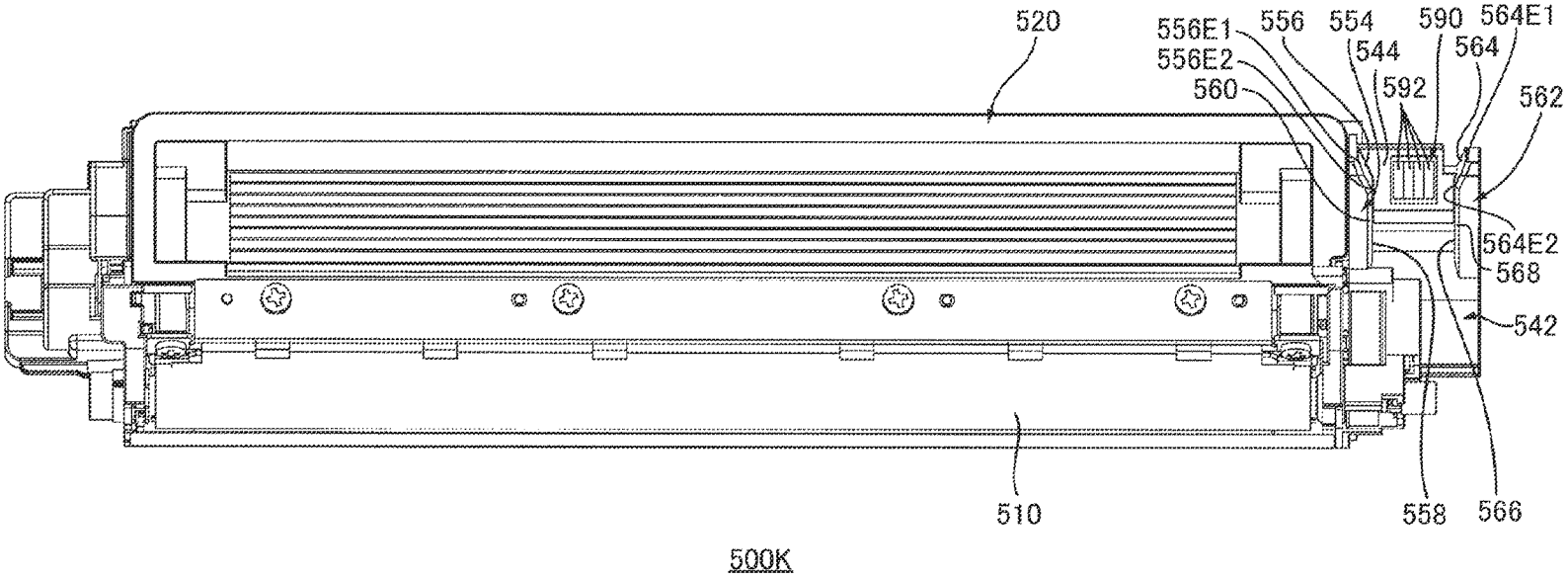

FIG. 20 is a front view of the developing cartridge.

Figure 21:
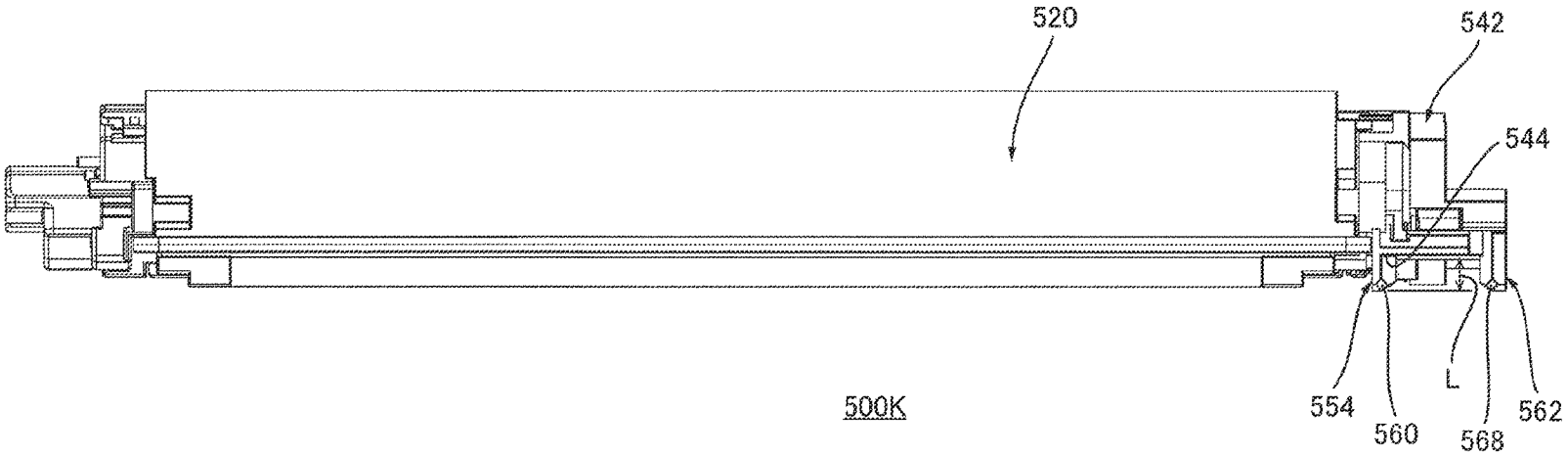

FIG. 21 is a top view of the developing cartridge.

Figure 22:
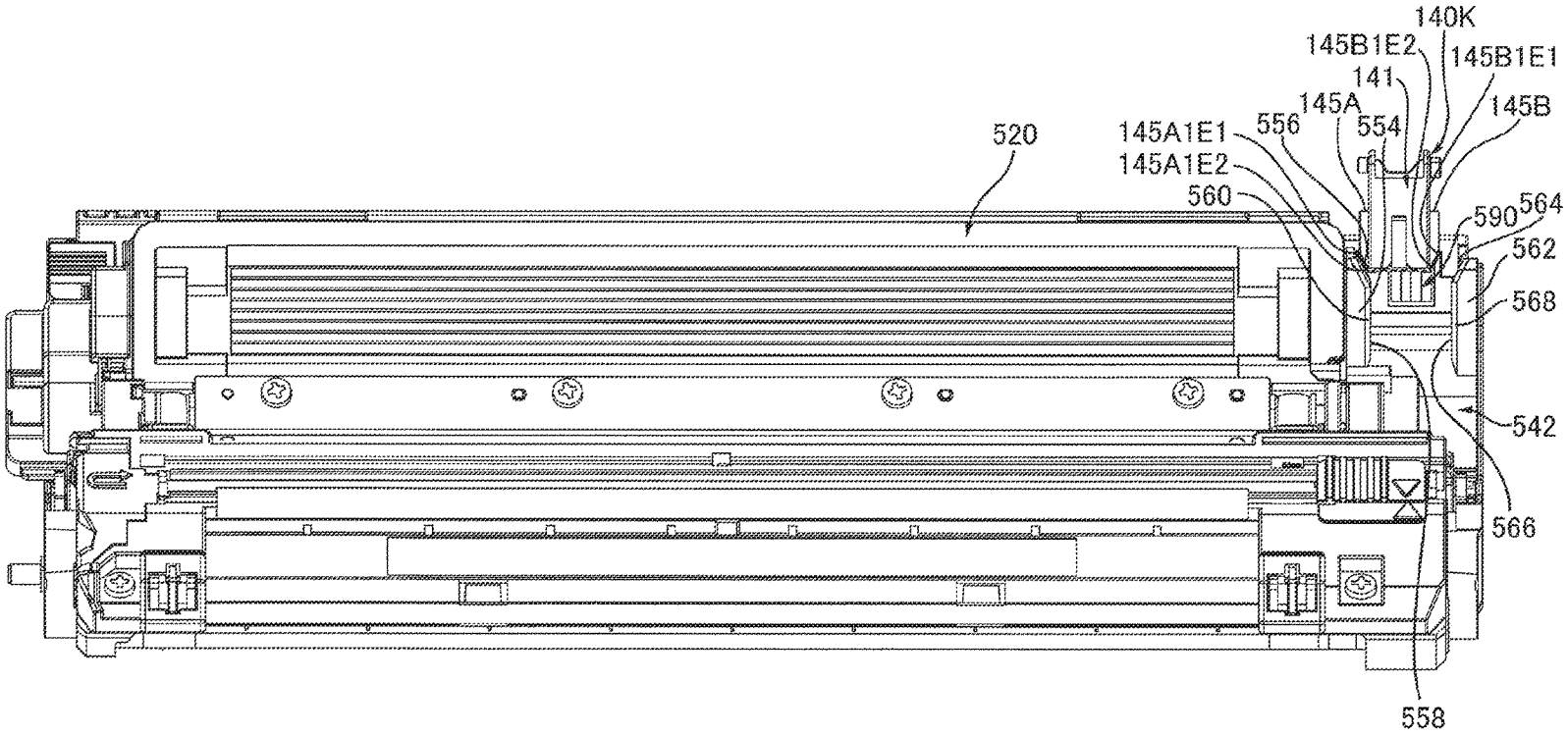

FIG. 22 is a front view of the developing cartridge and illustrates movement of the connector with respect to the holder of the developing cartridge.

Figure 23:
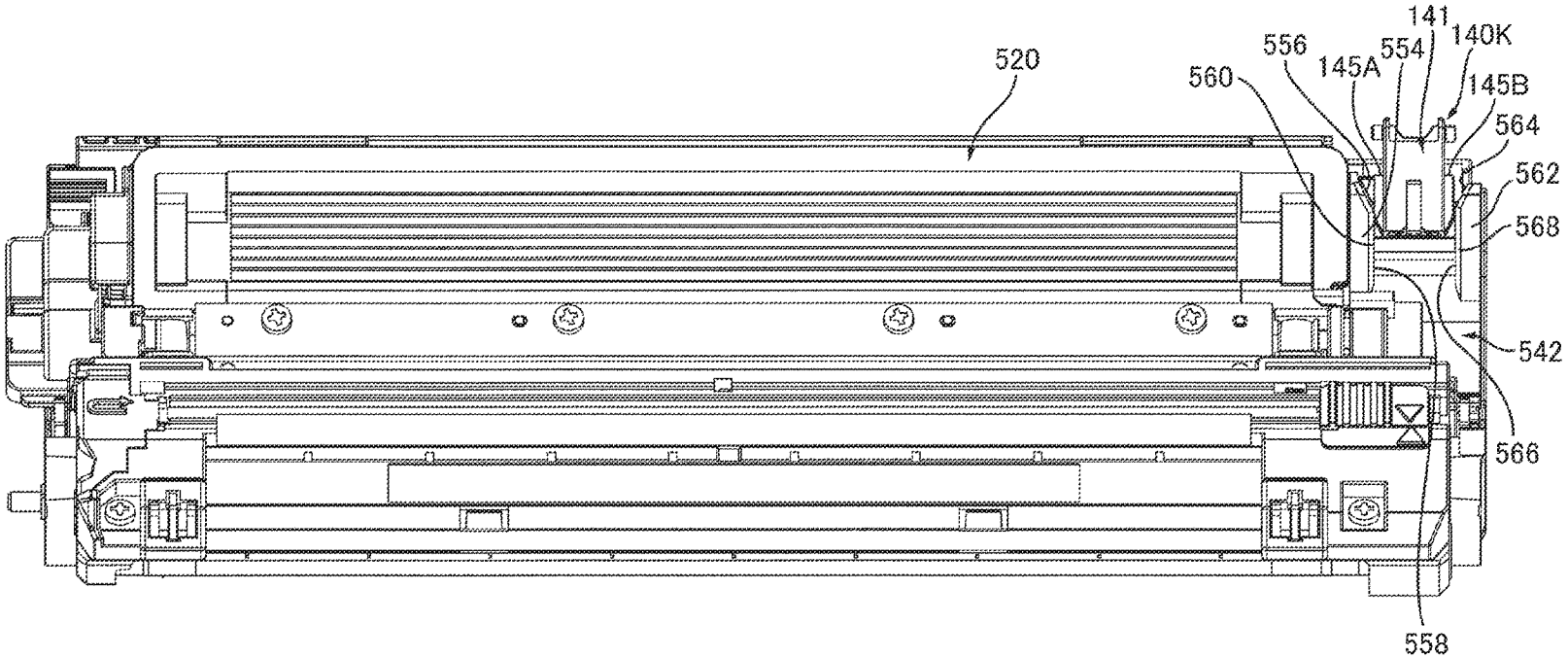

FIG. 23 is also a front view of the developing cartridge and illustrates movement of the connector with respect to the holder of the developing cartridge.

Figure 24:
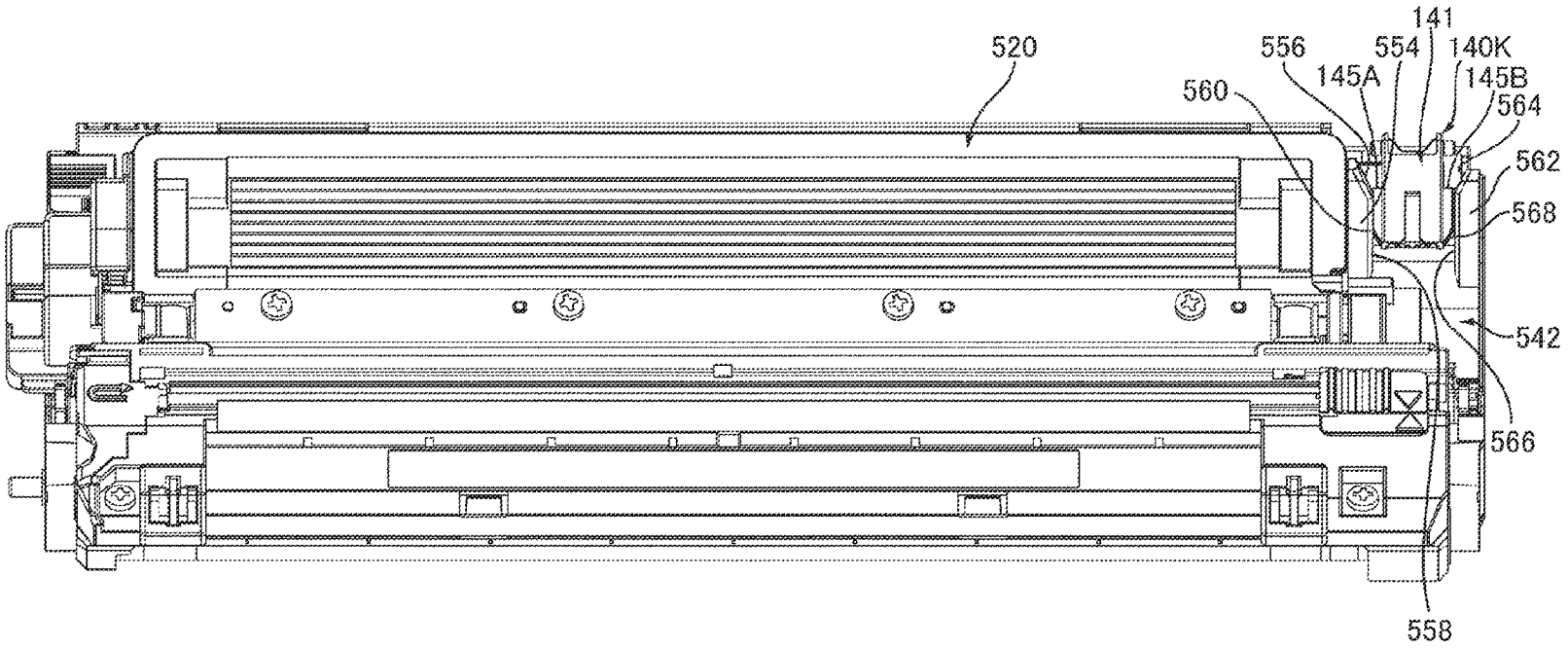

FIG. 24 is also a front view of the developing cartridge and illustrates movement of the connector with respect to the holder of the developing cartridge.

Figure 25B:
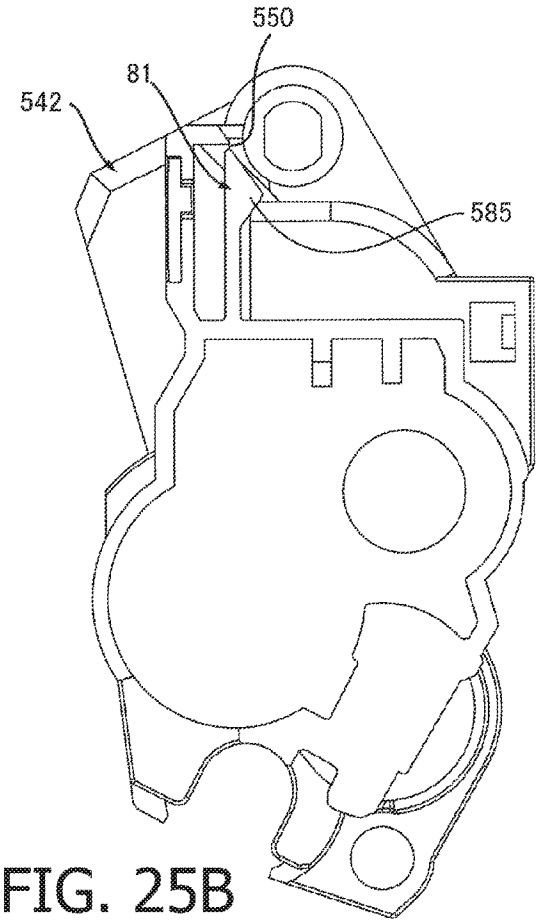
Figure 25A:
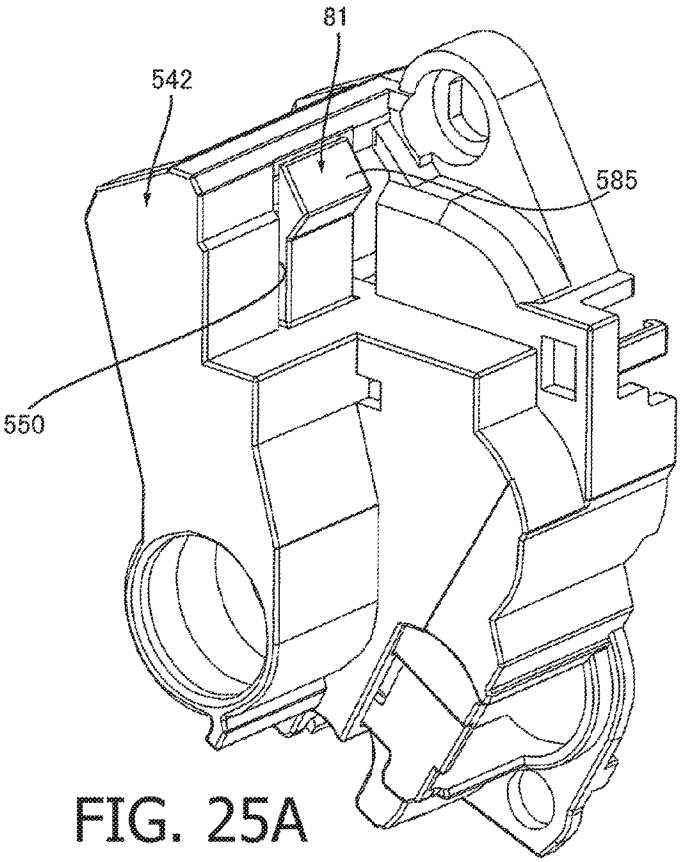

FIG. 25A illustrates a first modification of the illustrative embodiment in which a modified torsion spring is employed.

FIG. 25B is a cross-sectional view of a main holder according to the first modified embodiment.

Figure 26:
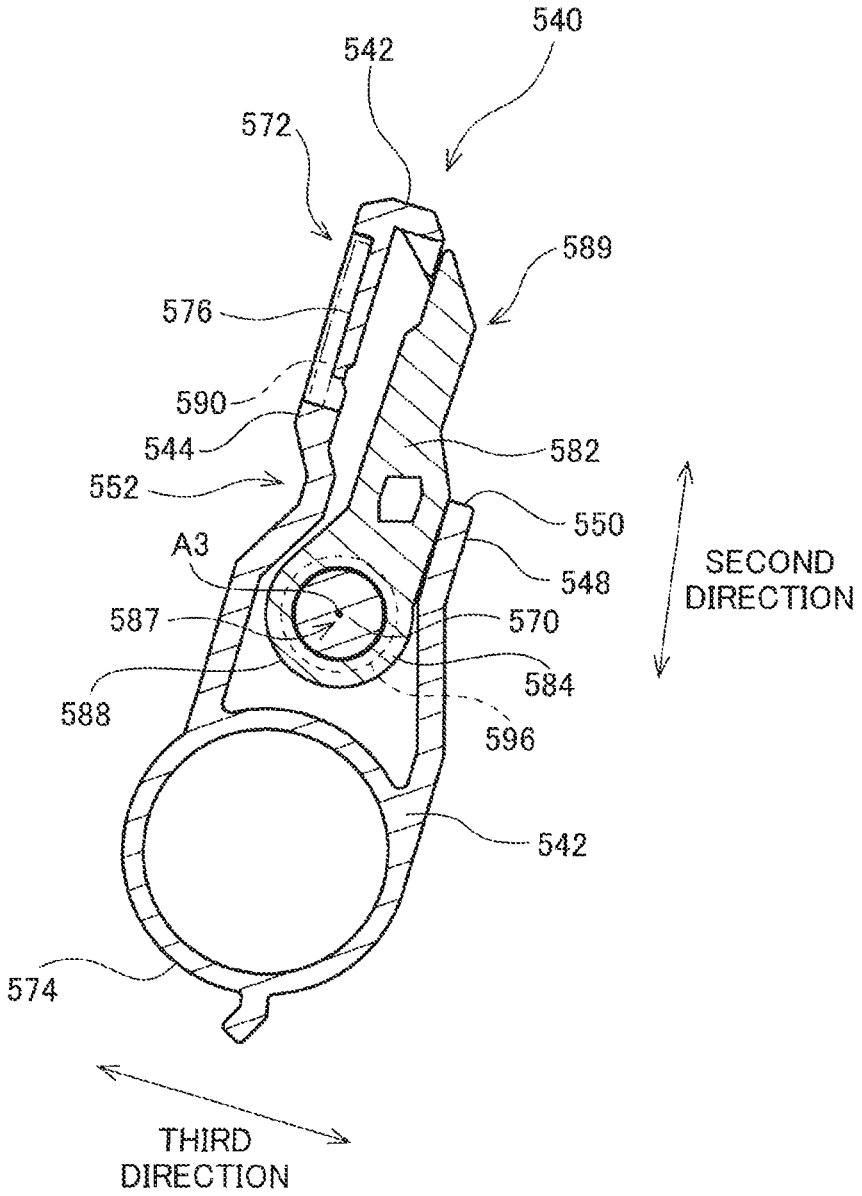

FIG. 26 illustrates a second modification of the illustrative embodiment employing a modified sub holder.

Figure 27:
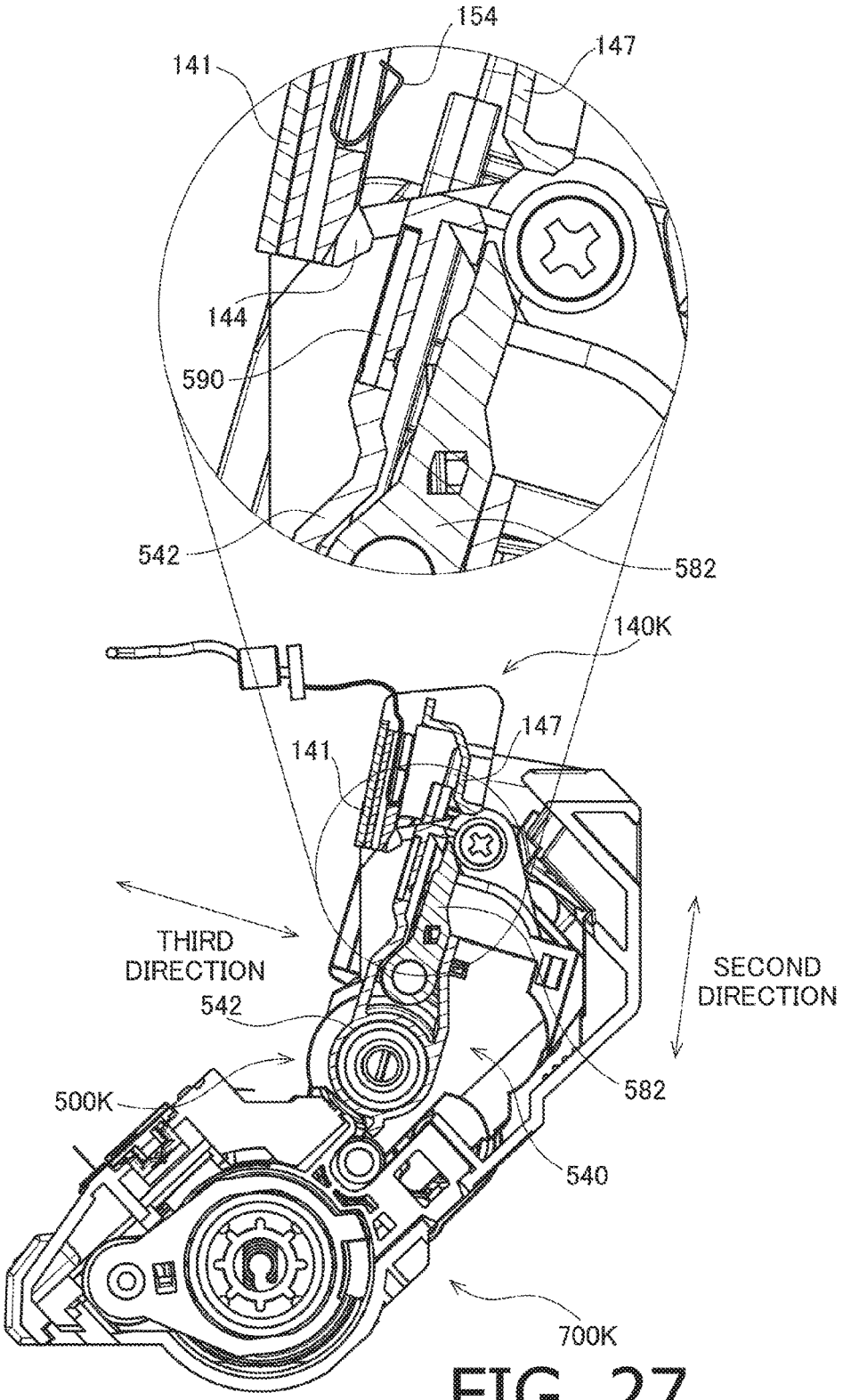

FIG. 27 illustrates movement of the connector with respect to the holder of the developing cartridge according to the second embodiment.

Figure 28:
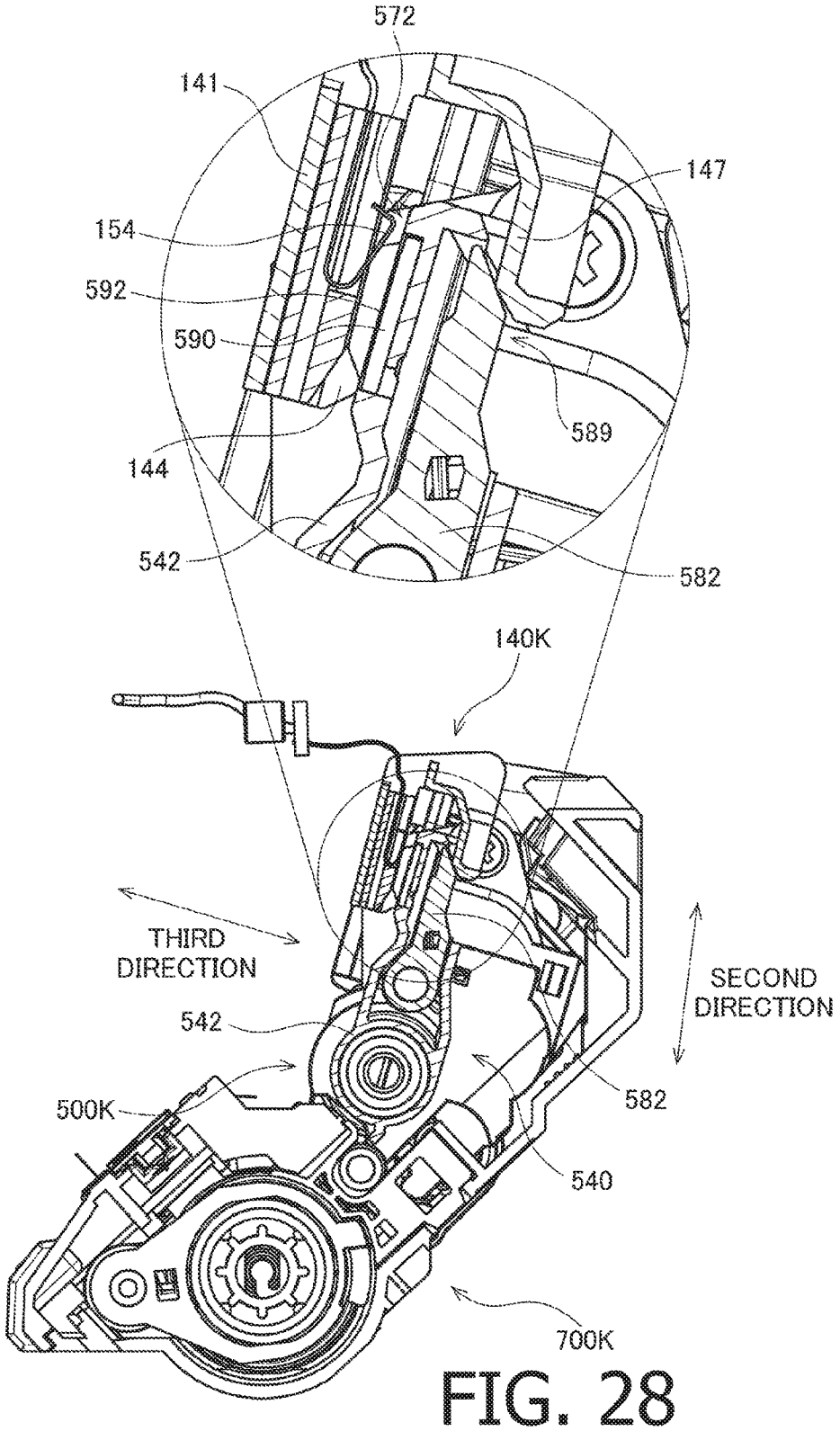

FIG. 28 also illustrates movement of the connector with respect to the holder of the developing cartridge according to the second embodiment.

Figure 29:
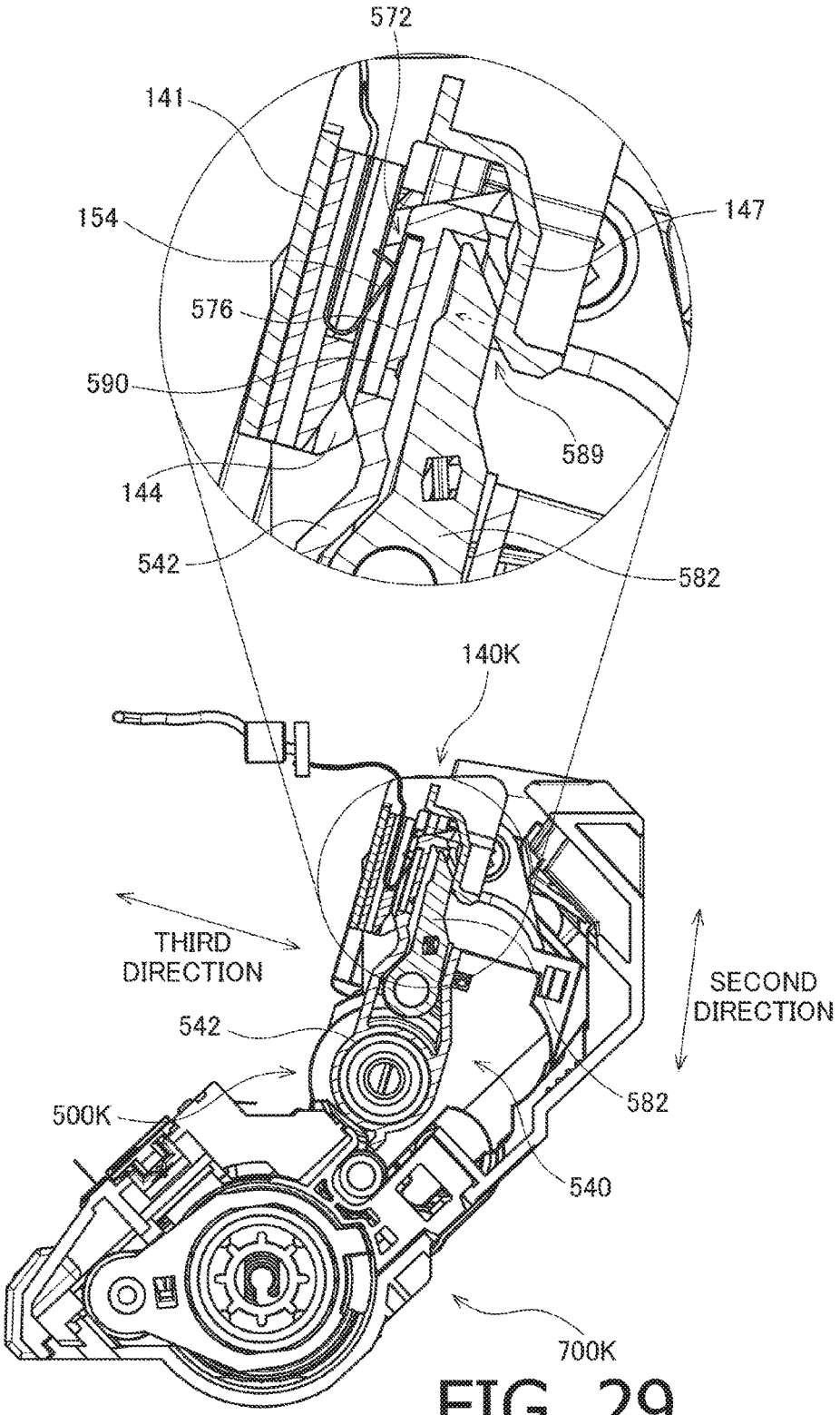

FIG. 29 also illustrates movement of the connector with respect to the holder of the developing cartridge according to the second embodiment.

Figure 30:
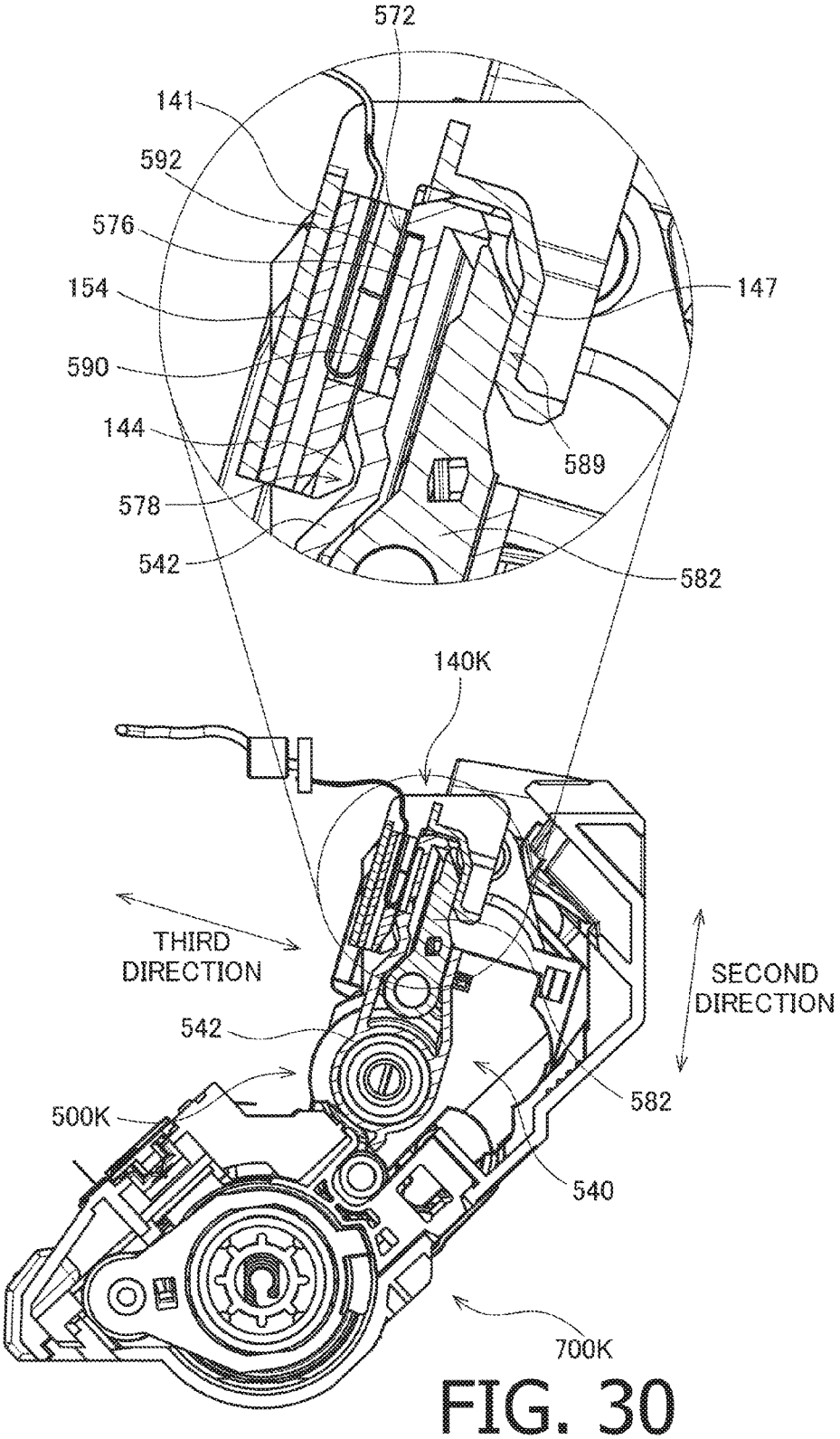

FIG. 30 also illustrates movement of the connector with respect to the holder of the developing cartridge according to the second embodiment.

DESCRIPTION OF ILLUSTRATIVE EMBODIMENTS

Hereinafter, embodiments according to the disclosures will be described with reference to the accompanying drawings.

1. General Description of Image Forming Apparatus

Figure 1:
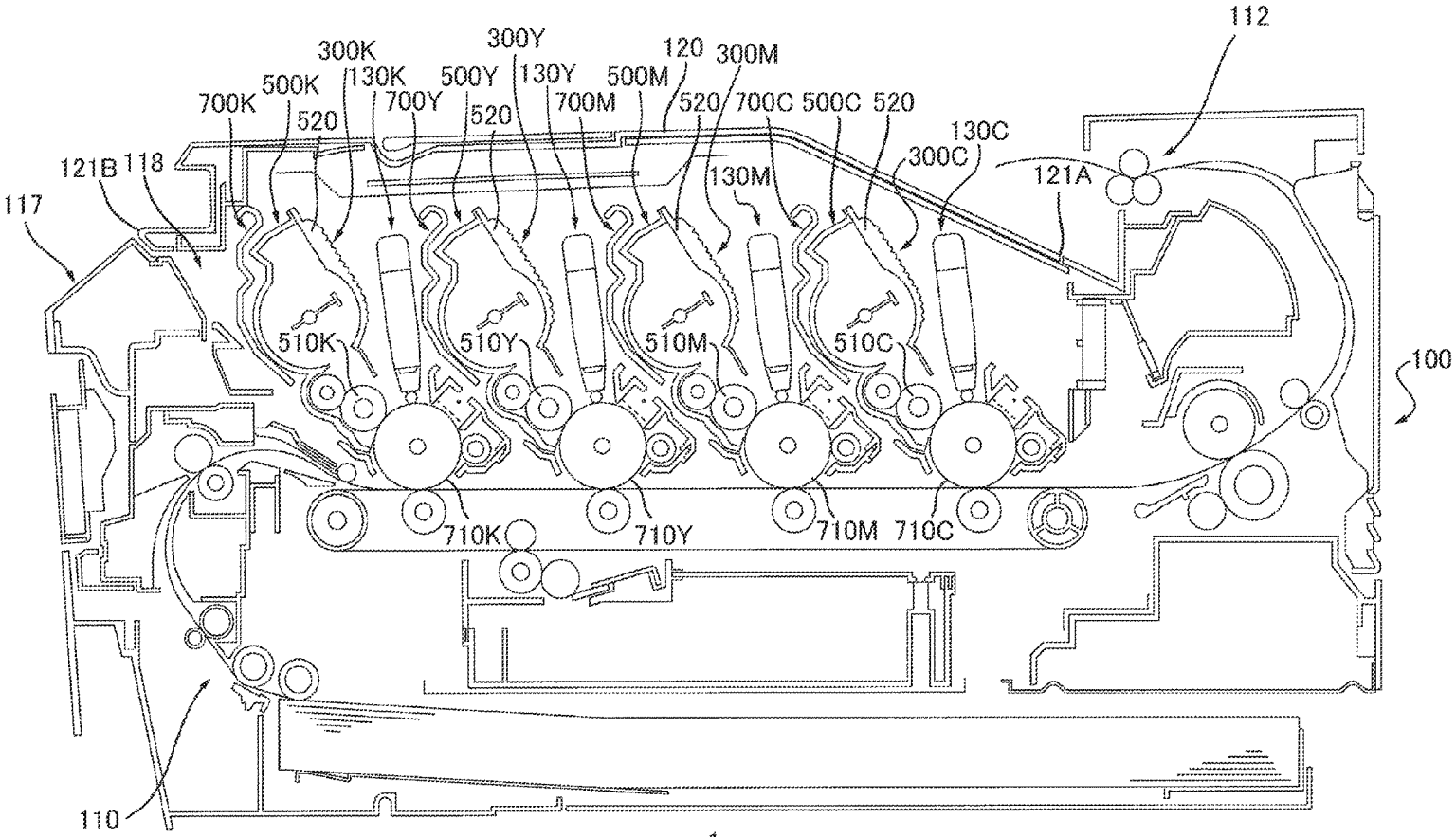
FIG. 1 is a cross sectional side view schematically showing general configuration of an image forming apparatus according to illustrative embodiment of the disclosures.

As shown in FIG. 1, an image forming apparatus 1 according to an illustrative embodiment has a main body 100, and multiple process cartridges 300K, 300Y, 300M and 300C which are detachably attached to the main body 100.

It is noted that a direction extending along a rotational axis A1 of a top cover 120 will be referred to as an "axial direction". Further, a direction in which a top cover 120 moves between a close position and an open position around the rotational axis A1 will be referred to as a "moving direction". In particular, a direction in which the top cover 120 moves from the open position to the close position will be referred to as a "closing direction". Further, a direction in which the top cover 120 moves from the close position to the open position will be referred to as an "opening direction". It is noted that the "moving direction" is perpendicular to the "axial direction". Further, a direction which is perpendicular to the "moving direction" and the "axial direction" will be referred to as an "orthogonal direction". A developing roller 510K extends along the axial direction in a state where the process cartridge 300K is attached to a main casing 117.

1.1 Image Forming Apparatus

As shown in FIG. 1, the image forming apparatus main body (hereinafter, simply referred to as a main body) 100 has a sheet feeder 110, and a discharging device 112. The sheet feeder 110 is configured to feed sheets toward photosensitive drums 710K, 710Y, 710M and 710C in a state where the process cartridges 300K, 300Y, 300M and 300C are attached to the image forming apparatus main body 100. The discharging device 112 is configured to discharge the sheets on which images are formed by the photosensitive drives 710K, 710Y, 710M and 710C in a state where the process cartridges 300K, 300Y, 300M and 300C are attached to the main body 100. The main body 100 further has the main casing 117, the top cover 120, the LED heads 130K, 130Y, 130M and 130C, and a control circuit board 135.

1.1.1 Main Casing

The main casing 117 has an opening 118 which opens upward. In other words, the opening 118 is provided at an upper portion of the main casing. The multiple process cartridges 300K, 300Y, 300M and 300C are detachably attached to the main casing 117 through the opening 118.

1.1.2 Top Cover

The top cover 120 is movable between the open position to open the opening 118, and the close position to close the opening 118. In other words, the top cover 120 is movable between an open position where the top cover 120 opens the opening 118 and a close position where the top cover 120 closes the opening 118. The top cover 120 has a first end part 121A and a second end part 121B. The top cover 120 extends from the first end part 121A to the second end part 121B. Further, the first end part 121A of the top cover 120 is rotatably supported by the main casing 117. The top cover 120 is rotatable between the open position and the close position around a rotational axis A1. In other words, the top cover is movable between the open position and the close position around the rotational axis A1. Thus, the top cover 120 is rotatable about the first end part 121A and rotates between the close position and the open position. The main casing 117 has a rotational shaft 117S extending in the rotational axis A1 as shown in FIG. 13. The top cover has a hinge 121A1 as shown in FIGS. 10 and 13. The rotational shaft 117S of the main casing 117 is inserted into the hinge 121A1 to allow the top cover to rotate between the open position and the close position around the rotational axis A1. The rotational axis A1 is an example of a first axis.

The top cover 120 covers an upper side of the multiple process cartridges 300K, 300Y, 300M and 300C attached to the main casing 117 in a state where the top cover 120 is positioned at the close position. It is noted that the multiple process cartridges 300K, 300Y, 300M and 300C can be removed from the main casing 117 through the opening 118 when the top cover 120 is positioned at the open position.

Figure 2:
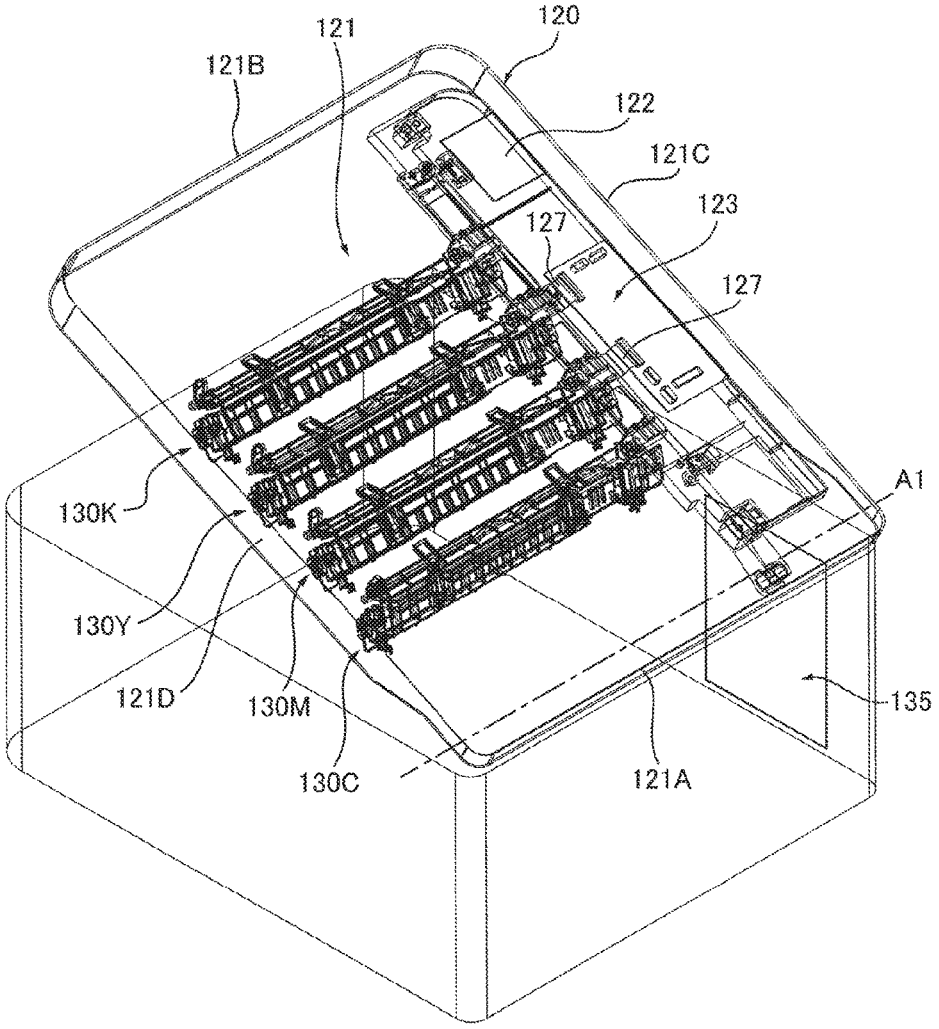
FIG. 2 is a perspective view of the image forming apparatus according to the illustrative embodiment.

As shown in FIG. 2, the top cover 120 supports an input device 122 and circuit board 123. The top cover 120 has a cover body 121. The cover body 121 extends in an arrangement direction along which the photosensitive drums 710K, 710Y, 710M and 710C are arranged when the top cover 120 is positioned at the close position. It is noted that the cover body 121 has the first end part 121A, and the second end part 121B which is an opposite end in the arrangement direction. Further, the cover body 121 has a third end part 121C, and a fourth end part 121D which is an opposite end part to the third end part 121C in the axial direction. It is noted that the arrangement part is defined with respect to the top cover 120 and coincides with the orthogonal direction in a state where the top cover is positioned at the close position.

1.1.2.1 Input Device

As shown in FIG. 2, the input device 122 is arranged on an upper surface of the top cover 120 at the second end part 121B side. The input device 122 is arranged, in the axial direction, between a central part of the cover body 121 and the third end part 121C. Instructions regarding operations of the image forming apparatus 1 are input to the input device 122. Further, the input device 122 is configured to display information regarding operations of the image forming apparatus 1.

1.1.2.2 Circuit Board

The circuit board 123 is supported by the top cover 120. The circuit board 123 is configured to control the multiple LED heads 130K, 130Y, 130M and 130C, the input device 122, and multiple connectors 140K, 140Y, 140M and 140C (described later). The circuit board 123 is arranged at a position between the central part of the cover body 121 and the third end part 121C of the cover body 121.

The circuit board 123 is electrically connected with the multiple LED heads 130K, 130Y, 130M and 130C, the input device 122, and the multiple connectors 140K, 140Y, 140M and 140C. Specifically, to the circuit board 123, a cable harness 127 is connected. The cable harness 127 includes electrical wirings connected to the multiple connectors 140K, 140Y, 140M and 140C, electrical wirings connected to the multiple LED heads 130K, 130Y, 130M and 130C, and an electrical wiring connected to the input device 122.

Further, as schematically shown in FIG. 4, the circuit board 123 includes a first circuit 124, a second circuit 125 and a third circuit 126. To the first circuit 124, the multiple connectors 140K, 140Y, 140M and 140C are electrically connected. That is, to the first circuit 124, a plurality of main body electrical contacts 154 (described later) is electrically connected. To the second circuit 125, the multiple LED heads 130K, 130Y, 130M and 130C are electrically connected. To the third circuit 126, the input device 122 is electrically connected. In other words, the first circuit 124 of the circuit board 123 is electrically connected to the main body electrical contacts 154 and the second circuit 125 of the circuit board 123 is electrically connected to the LED heads 130K, 130Y, 130M and 130C. The main body electrical contact 154 is an example of the second electrical contact.

1.1.3 LED Heads

As shown in FIGS. 1, 2 and 10, the multiple LED heads 130K, 130Y, 130M and 130C are supported by the top cover 120. Further, the multiple LED heads 130K, 130Y, 130M and 130C are arranged in the "arrangement direction" in which direction the multiple photosensitive drums 710K, 710Y, 710M and 710C are arranged. The multiple LED heads 130K, 130Y, 130M and 130C are arranged at particular intervals in the arrangement direction. Each of the multiple LED heads 130K, 130Y, 130M and 130C extends in the axial direction. The LED heads 130K, 130Y, 130M and 130C are movably supported by the top cover 120. The LED head 130K is movable around the axis A2K extending in the axis direction with respect to the top cover 120 as shown in FIG. 10. The axis A2K of the LED head 130K is an example of the second axis. The LED head 130Y is movable around the axis A2Y extending in the axis direction with respect to the top cover 120 as shown in FIG. 10. The LED head 130M is movable around the axis A2M extending in the axis direction with respect to the top cover 120 (not shown in FIG. 10). The LED head 130C is movable around the axis A2C extending in the axis direction with respect to the top cover 120 as shown in FIG. 10.

Specifically, the LED head 130K faces the photosensitive drum 710K when the top cover 120 is positioned at the close position. The LED head 130K is configured to emit light so that a circumferential surface of the photosensitive drum 710K is exposed to the light. Similarly, the LED head 130Y faces the photosensitive drum 710Y in a state where the top cover 120 is positioned at the close position. The LED head 130Y is configured to expose a circumferential surface of the photosensitive drum 710Y with light. The LED head 130M faces the photosensitive drum 710M in a state where the top cover 120 is positioned at the close position. The LED head 130M is configured to expose a circumferential surface of the photosensitive drum 710M with light. Further, the LED head 130C faces the photosensitive drum 710C in a state where the top cover 120 is positioned at the close position. The LED head 130C is configured to expose a circumferential surface of the photosensitive drum 710C with light.

1.1.4 Control Circuit Board

Figure 3:
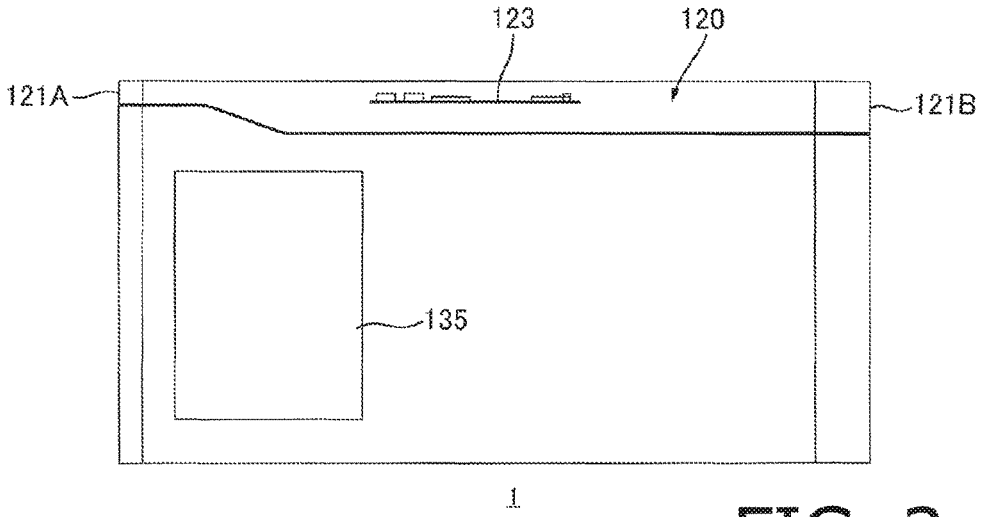
FIG. 3 is a side view of the image forming apparatus according to the illustrative embodiment.

The main casing 117 supports a control circuit board 135 as shown in FIGS. 2 and 3. The control circuit bard 135 is configured to control operations of the image forming apparatus 1. As shown in FIG. 2, the control circuit board 135 is arranged on inner face of a side wall of the main casing 117. Further, the control circuit board 135 is arranged, in the axial direction, between the central part of the cover body 121 and the third end part 121C of the cover body 121.

1.2 Process Cartridges

The process cartridges 300K, 300Y, 300M and 300C has multiple developing cartridges 500K, 500Y, 500M and 500C, and the multiple drum cartridges 700K, 700Y, 700M and 700C, respectively. The developing cartridges 500K, 500Y, 500M and 500C are detachably attached to the drum cartridges 700K, 700Y, 700M and 700C, respectively. The process cartridges 300K, 300Y, 300M and 300C are detachable from/attachable to the main casing 117 through the opening 118 in a state where the top cover 120 is positioned at the open position.

1.2.1 Developing Cartridges

The developing cartridges 500K, 500Y, 500M and 500C accommodate black toner, yellow toner, magenta toner and cyan toner, respectively. The multiple developing cartridges 500K, 500Y, 500M and 500C have the same structure, and only the colors of developing agents contained therein are different. Therefore, in the following description, only the configuration of the developing cartridge 500K will be described in detail, and description on the other developing cartridges 500Y, 500M and 500C will be omitted.

The developing cartridge 500K has, as shown in FIGS. 5 and 6, a cartridge casing 520 and a developing roller 510. The cartridge casing 520 is configured to accommodate developing agent (i.e., toner). The cartridge casing 520 is a hollow polygonal cylinder. The developing roller 510 is rotatable about an axis which extends in the axial direction, which is a direction orthogonal to the arrangement direction. Further, the developing roller 510 is located at an end part of the cartridge casing 520. The developing roller 510 has a cylindrical shape. A part of the circumferential surface of the developing roller 510 is exposed to outside of the cartridge casing 520.

1.2.2 Drum Cartridges

The drum cartridges 700K, 700Y, 700M and 700C have photosensitive drums 710K, 710Y, 710M and 710C, respectively.

The multiple photosensitive drums 710K, 710Y, 710M and 710C respectively correspond to the developing cartridges 500K, 500Y, 500M and 500C. Since the multiple photosensitive drums 710K, 710Y, 710M and 710C have the same structures except that the corresponding developing cartridges are different. Therefore, in the following description, only the photosensitive drum 710K is described in detail, and description of the other photosensitive drums will be omitted.

The photosensitive drum 710K is rotatable about an axis extending in the axial direction. The photosensitive drum 710K is provided to the drum cartridge 700K. In other words, the drum cartridge 700K has the photosensitive drum 710K. The developing cartridge 500K is attachable to/detachable from the drum cartridge 700K. In a state where the developing cartridge 500K is attached to the drum cartridge 700K, the developing roller 510 of the developing cartridge 500K contacts the photosensitive drum 710K. The drum cartridge 700K to which the developing cartridge 500K is attached is attached to a drum cartridge holding part (not shown) provided to the image forming apparatus 1.

1.2.2.1 Cartridge Side Spacing Member

As shown in FIG. 5, the drum cartridge 700K has a cartridge side spacing member 720. The cartridge side spacing member 720 is a member which is configured to urge the developing cartridge 500K in a direction where the developing roller 510 moves away from the photosensitive drum 710K. The cartridge side spacing member 720 is arranged, in the axial direction, on a side surface of the drum cartridge 700K. The cartridge side spacing member 720 is rotatably supported by the drum cartridge 700K. Further, the cartridge side spacing member 720 faces a main holder 542 (described later) of the memory holder 540 when the developing cartridge 500K is attached to the drum cartridge 700K. The cartridge side spacing member 720 is driven to rotate by a driving force transmitted from a driving source 197 (described later). The cartridge side spacing member 720 contacts the main holder 542 and urges the main holder 542 in a direction where the developing roller 510 moves away from the photosensitive drum 710K. The driving source 197 is provided to the main body 100 of the image forming apparatus 1. It is noted that a direction in which the developing roller 510 moves away from the photosensitive drum 710K is the same direction as the opening direction.

With the above-described configuration, as the main holder 542 is urged by the cartridge side spacing member 720, the developing cartridge 500K is moved from a contacting position (see FIG. 18) to a spaced position (see FIG. 19). Further, as urging of the cartridge side spacing member 720 to the main holder 542 is released, the developing cartridge 500 is moved from the spaced position (see FIG. 19) to the contacting position (see FIG. 18). The contacting position is a position at which the developing roller 510 and the photosensitive drum 710K contact each other. The spacing position is a position at which the developing roller 510 and the photosensitive drum 710K separate from each other.

2. Description on Developing Cartridge

The developing cartridge 500*k* has the developing roller 510 and the cartridge casing 520. As shown in FIGS. 6, 7 and 8, the developing cartridge 500K further has a first gear section 530, a memory holder 540, an IC chip 590 having memory electrical contacts 592, and a torsion spring 596. In a state where the developing cartridge 500K is attached to the drum cartridge 700K, the developing roller 510 contacts the photosensitive drum 710K provided inside the drum cartridge 700K. As shown in FIG. 8, the first gear section 530, the IC chip 590 and the memory holder 540 are arranged on one side (and the same side), in the axial direction (i.e., the first direction), of the cartridge casing 520. The IC chip 590 is an example of a memory. The memory electrical contact 592 is an example of a first electrical contact. The tension spring 596 is an example of a spring.

2.1 Developing Roller

The developing roller 510 is a roller which is configured to rotate about a rotation axis extending in the axial direction. The developing roller 510 according to the illustrative embodiment has a roller body and a roller shaft. The roller body is a cylindrical member extending in the axial direction. The roller body is made of, for example, rubber having elasticity. The roller shaft is a cylindrical member which penetrates through the roller main body in the axial direction. The roller shaft is made of metal or electrically conductive resin. The developing roller 510 is arranged on an end part, in a direction perpendicular to the axial direction, of the cartridge casing 520. In other words, the developing roller 510 is positioned at a lower part of the cartridge casing 520.

It is noted that the roller shaft need not be configured to penetrate through the roller body in the axial direction. For example, a pair of roller shafts may extend out in the axial direction from both sides, in the first direction, of the roller body.

The developing cartridge 500K is optionally configured to have an agitator. Such an agitator may have an agitator shaft and an agitating impeller. The agitator shaft may extend along a rotation axis which extends in the axial direction. The agitating impeller may be configured to extend, in a radial direction, outward from the agitator shaft. The agitating impeller may be arranged inside a developer reservoir of the cartridge casing 520. At both ends, in the axial direction, of the agitator shaft, agitator gears may be secured, respectively.

2.2 Cartridge Casing

The cartridge casing 520 is a case configured to accommodate developing agent (e.g., toner) for electrophotographic image formation. Inside the cartridge casing 520, the developer reservoir configured to accommodate the developing agent is provided. Thus, the cartridge casing 520 is configured to accommodate the developing agent therein. As shown in FIG. 8, the cartridge casing 520 has first outer surface 522 which is an end surface, in the axial direction, of the cartridge casing 520.

2.3 First Gear Section

The first gear section 530 has multiple gears 532. The multiple gears 532 include, for example, a coupling 534. Further, the multiple gears 532 include a developing gear 532A, an idle gear, and the agitator gears. Each gear is configured to rotate about its rotation axis which extends in the axial direction. It is noted that, in FIG. 8, teeth of each of the multiple gears 532 are not shown for brevity. The developing gear 532 A is an example of a gear.

The coupling 534 is arranged at first side (i.e., a right-hand side in FIGS. 5, 6 and 8, etc.), in the first direction, of the developing roller 510. The coupling 534 is arranged at a side surface side of the cartridge casing 520 in the axial direction. The coupling 534 has a cylindrical shape and extends in the axial direction. The coupling 534 is rotatable about a rotational axis which extends in the axial direction. The coupling 534 is configured to receive a driving force from the driving source provided to the main casing 117 when the developing cartridge 500K is attached to the main casing 117. The driving force received by the coupling 534 is transmitted to the developing roller 510 through a not-shown gear train. Then, the developing roller 510 is rotated by the driving force. The developing gear 532A is configured to transmit the driving force from the coupling 534 to the developing roller 510.

2.4 Memory Holder

As shown in FIG. 8, the memory holder 540 has a main holder 542 and a sub holder 582. The main holder 542 and the sub holder 582 are made of, for example, resin. The main holder 542 is fixed to a first outer surface 522 of the cartridge casing 520 with screws. At least a part of the plurality of gears 532 is arranged between the first outer surface 522 and the main holder 542. In other words, the developing gear 532A is positioned between the first outer surface 522 of the cartridge casing 520 and the main holder 542 of the memory holder 540.

2.4.1 Main Holder

The main holder 542 is attached to the side surface, in the axial direction, of the cartridge casing 520. The main holder 542 covers at least a part of the plurality of gears 532. That is, the main holder 542 serves as a gear cover. It is noted that the coupling 534 is exposed through the main holder 542.

The main holder 542 has a first end part 574 and a second end part 572, in a direction where the top cover 120 moves toward the closing direction. The second end part 572 is positioned farther than the first end part 574, in the moving direction, with respect to the developing roller 510. The second end part 572 has a first outer surface 544, a second outer surface 546, a third outer surface 548, an opening 550, and a groove 552. The first outer surface 544 and the groove 552 are shown in the FIG. 8. The second outer surface 546, the third outer surface 548, and an opening 550 are shown in the FIG. 7. The second end part 572 of the main holder 542 has a first guide plate 554 and a second guide plate 562 as shown in the FIGS. 8 and 20. Further, the main holder 542 has a shaft 570. The second end part 574 has a first inner surface 545 opposite from the first outer surface 544 as shown in FIG. 14.

2.4.1.1 First Outer Surface

The first outer surface 544 is located at one end part of the main holder 542 as shown in the FIG. 8. The first outer surface 544 is directed to the orthogonal direction which intersects with the moving direction. The first outer surface 544 extends in the moving direction. The first outer surface 544 has a holding surface 575. The holding surface 575 supports an IC chip 590 (described later). In other words, the IC chip 590 is provided on the first outer surface 544 of the main holder 590. The first outer surface 544 is an example of a second surface.

2.4.1.2 Second Outer Surface

The second outer surface 546 is located at the second end part 572 of the main holder 542 as shown in the FIG. 7. The second outer surface 546 is directed to the orthogonal direction. The second outer surface 546 is located next to the first outer surface 544, in the orthogonal direction, with a space therebetween. The second outer surface 546 is arranged on an opposite side with respect to the first outer surface 544, in the orthogonal direction (see FIG. 7). The second outer surface 546 extends in the moving direction.

2.4.1.3 Third Outer Surface

The third outer surface 548 is located at the second end part 572 of the gear cover 542 as shown in the FIG. 7. The third outer surface 548 is directed to the moving direction. The third outer surface 548 is located between the first outer surface 544 and the second outer surface 546, in the orthogonal direction. The third outer surface 548 extends in the orthogonal direction.

2.4.1.4 Opening

The opening 550 is formed on the second outer surface 546 as shown in the FIG. 7. The opening 550 penetrates though the second outer surface 546 in the orthogonal direction.

2.4.1.5 Groove

The groove 552 is formed on the first outer surface 544 as shown in the FIGS. 8 and 14. The groove 552 is located, in the moving direction, at a position closer to the developing roller 510 than the IC chip 590. In other words, the groove 552 is positioned lower than the IC chip 590 in a state where the process cartridge 300K is attached to the main casing 117. The groove 552 is recessed from the first outer surface 544 toward the second outer surface 546. The groove 552 is configured to receive two guide protrusions 144 (see FIG. 11A) which will be described later. Thus, the developing cartridge 500K has the groove 552 with which the guide protrusions 144 engage in a state where the developing cartridge 500K is attached to the main casing 117 and the top cover 120 is positioned at the close position. The groove 522 is located on a downstream side with respect to the memory electrical contacts 592 of the IC chip 590. According to the illustrative embodiment, the groove 578 and the holding surface 575 are arranged in the moving direction. The groove 552 is an example of the second recess.

2.4.1.6 Cylindrical Shaft

The main holder 542 has the cylindrical shaft 570 extending in the axial direction on the inner surface of the main holder 542 as shown in FIG. 9. The cylindrical shaft 570 has a cylindrical shape. The cylindrical shaft 570 is to be inserted in a circular hole 587 of the sub holder 582 (described in detail later).

2.4.1.7 First Guide Plate

A first guide plate 554 is positioned on the first outer surface 544. The first guide plate 554 contacts a first contact rib 145A of the connector 140K in a state where the developing cartridge 500K is attached to the main casing 117 and in a state where the top cover 120 is positioned at the close position. The first guide plate 554 guides the first contact rib 145A of the connector 140K when the top cover 120 moves between the open position and the close position in a state where the developing cartridge 500K is attached to the main casing 117. The first guide plate 554 is positioned, in the axial direction, on one side of the IC chip 590. The first guide plate 554 is positioned between the memory electrical contacts 592 of the IC chip 590 and the cartridge casing 520, in the axial direction. The first guide plate 554 is positioned at a position spaced away from the memory electrical contacts 592 in the axial direction. The first guide plate 554 protrudes from the first outer surface 544 in the orthogonal direction. Further, the first guide plate 554 extends in the moving direction.

The first guide plate 554 has an upstream end part and a downstream end part in the moving direction. As shown in FIG. 8, the first guide plate 554 is inclined such that a portion thereof closer to the first end part 574 is closer to the IC chip 590. In the orthogonal direction, a dimension L of the first guide plate 554 (see FIG. 21) is the longest in the upstream end in the opening direction. It is noted that the dimension L of the first guide plate 554 is a distance between the first outer surface 544 and a tip end of the first guide plate 554 in a direction when the first guide plate 554 protrudes from the first outer surface 544. The first guide plate 554 has a first surface 556, a second surface 558 and an inclined surface 560.

2.4.1.7.1 First Surface

The first surface 556 is located at an end part on the upstream side, in the moving direction, with respect to the first guide plate 554. The first surface 556 faces the second guide plate 562 in the axial direction. The first surface 556 is positioned at a position spaced away from the memory electrical contact 592 of the IC chip 590 in the axial direction. The first face 556 inclines such that a portion on the first surface 556 on a further downstream side in the closing direction is closer to the memory electrical contact 592. Specifically, the first surface 556 has an upstream end 556E1, and a downstream end 556E2 which is an opposite end in the closing direction as shown in the FIG. 20. A distance between the upstream end 556E1 and the memory electrical contact 592 in the axial direction is longer than a distance between the downstream end 556E2 of the first surface and the memory electrical contact 592 in the axial direction. The upstream end 556E1 of the first surface 556 is positioned at an upper end of the first surface 556 in a state where the process cartridge 300 K is attached to the main casing 117. The downstream end 556E2 of the first surface 556 is positioned at a lower end of the first surface 556 in a state where the process cartridge 300 K is attached to the main casing 117. The first surface 556 is an example of a first guide surface. The upstream end 556E1 of the first surface 556 is an example of an upper end of the first surface 556. The downstream end 556E2 of the first surface 556 is an example of a lower end of the first surface 556.

2.4.1.7.2 Second Surface

The second surface 558 is arranged next to the first surface 556 in the moving direction. The second face 558 is continuously connected to the downstream end 556E2, in the moving direction, of the first face 556. The second face 558 extends in the moving direction. Specifically, the second surface 558 has an upstream end and a downstream end which is opposite, in the closing direction, to the upstream end. A distance, in the axial direction, between the upstream end and the memory electrical contacts 592 is equal to a distance, in the axial direction, between the downstream end and the memory electrical contacts 592. Further, in the closing direction, the downstream end of the second surface 558 is located on the downstream side with respect to the memory electrical contacts 592.

2.4.1.7.3 Inclined Surface

The inclined surface 560 is located at a tip end part of the first guide plate 554 in a direction where the first guide plate 554 protrudes. The inclined surface 560 inclines such that a portion, on the inclined surface 560, closer to the first outer surface 544 in the orthogonal direction is closer to the memory electrical contact 592. Specifically, the inclined surface 560 has a first end closer to the memory electrical contacts 592 in the axial direction and a second end located on an opposite side to the first end. A distance, in the orthogonal direction, between the first end of the inclined surface 560 and the memory electrical contacts 592 is smaller than a distance, in the orthogonal direction, between the second end of the inclined surface 560 and the memory electrical contact 592.

2.4.1.8 Second Guide Plate

The second guide plate 562 is positioned on the first outer surface 544. The second guide plate 562 faces the first guide plate 554 in the axial direction. Specifically, the second guide plate 562 is spaced away from the first guide plate 554 in the axial direction by a particular distance. The second guide plate 544 contacts a second contact rib 145B of the connector 140K in a state where the cartridge 300 is attached to the main casing 117 and in a state where the top cover 120 is positioned at the close position. The second guide plate 562 guides the second contact rib 145B of the connector 140K when the top cover 120 moves between the open position and the close position in a state where the developing cartridge 500K is attached to the main casing 117. The second guide plate 562 is positioned on the first side with respect to the IC chip 590 in the axial direction. The second guide plate 562 is spaced away from the memory electrical contact 592 in the axial direction. The second guide plate 562 protrudes outward from the first outer surface 544 in the orthogonal direction. That is, the second guide plate 562 extends in the orthogonal direction.

Further, the second guide plate 562 extends in the moving direction. The second guide plate 562 has an upstream end part and a downstream end part in the closing direction. The second guide plate 562 is also inclined such that a portion between the second end part 572 of the main holder 542 and the first end part 574 of the main holder 542 and closer to the first end part 574 is closer to the IC chip 590. In the orthogonal direction, the dimension of the second guide plate 562 is the same as the dimension L of the first guide plate 554. The second guide plate 562 has a first surface 564, a second surface 566 and an inclined surface 568.

In the axial direction, the IC chip 590 is positioned between the first guide plate 554 and the second guide plate 562. That is, the memory electrical contacts 592 is arranged between the first guide plate 554 and the second guide plate 562. It is noted that, in the closing direction, from the second end part 572 to the memory electrical contacts 592 of the IC chip 590, a distance, in the moving direction, between the first guide plate 554 and the second guide palate 562 is shorter.

2.4.1.8.1 First Surface

The first surface 564 is located on the upstream end of the second guide plate 562. The first surface 564 faces the first surface 556 of the first guide palate 554 in the axial direction. The first surface 564 faces the first surface 556 of the first guide plate 554. The first surface 564 is spaced away from the memory electrical contacts 592 in the axial direction. The first surface 564 is inclined such that a portion of the first surface 564 closer to the downstream in the closing direction is closer to the memory electrical contacts 592. Specifically, the first surface 564 has an upstream end 564E1 and a downstream end 564E2 which is opposite, in the closing direction, to the upstream end as shown in the FIG. 20. A distance, in the axial direction, between the upstream end of the second surface 566 and the memory electrical contact 562 is greater than a distance, in the axial direction, between the downstream end of the second face 566 and the memory electrical contact 562. The upstream end 564E1 of the first surface 564 is positioned at an upper end of the first surface 564 in a state where the process cartridge 300 K is attached to the main casing 117. The downstream end 564E2 of the first surface 564 is positioned at a lower end of the first surface 564 in a state where the process cartridge 300 K is attached to the main casing 117. The first surface 564 is an example of a second guide surface. The upstream end 564E1 of the first surface 564 is an example of an upper end of the first surface 564. The downstream end 564E2 of the first surface 564 is an example of a lower end of the first surface 564.

A distance between the upstream end 556E1 of the first surface 556 and the upstream end 564E1 of the first surface 564 in the axial direction is larger than a distance between a downstream end 556E2 of the first surface 556 and a downstream end 564E2 of the first surface 564 in the axial direction as shown in the FIG. 20.

2.4.1.8.2 Second Surface

The second surface 566 is arranged next to the first face 564 in the moving direction. The second surface 566 is continuously connected to the downstream end, in the moving direction, of the first surface 564. The second surface 566 extends in the moving direction. Specifically, the second surface 566 has an upstream end and a downstream end which is opposite, in the closing direction, to the upstream end. A distance, in the axial direction, between the upstream end of the second surface 566 and the memory electrical contacts 592 is equal to a distance, in the axial direction, between the downstream end of the second surface 566 and the memory electrical contacts 592. Further, in the closing direction, the downstream end of the second surface 566 faces the second surface 558 of the first guide plate 554 in the axial direction.

2.4.1.8.3 Inclined Surface

The inclined surface 568 is located at a tip end part of the second guide plate 562 in a direction where the second guide plate 562 protrudes. The inclined surface 568 inclines such that a portion, on the inclined surface 568, closer to the first outer surface 544 in the orthogonal direction is closer to the memory electrical contacts 592. Specifically, the inclined surface 568 has a first end closer to the memory electrical contact 592 in the axial direction and a second end located on an opposite side to the first end. A distance, in the orthogonal direction, between the first end of the inclined surface 568 and the memory electrical contact 592 is smaller than a distance, in the orthogonal direction, between the second end of the inclined surface 568 and the memory electrical contact 592.

2.4.1.9 First Inner Surface

The first inner surface 545 is a surface opposite from the first outer surface 544 as shown in FIG. 14. The first inner surface 545 faces s sub holder (582). The first inner surface 545 is an example of the first surface.

2.4.2 Sub Holder

The sub holder 582 is movable with respect to the main holder 542. To be specific, the sub holder 582 is configured to pivot around an axis extending in the axis direction. In other words, the sub holder 582 is pivotally supported by the main holder 542. The sub holder 582 extends in the moving direction as shown in FIG. 8. The sub holder 582 has a first end part 588, and a second end part 589 which is spaced from the first end part 588, in the moving direction. The sub holder 582 has a shaft part 584 and a protrusion 585 (see FIG. 9).

2.4.2.1 Shaft Part

The shaft part 584 is located at the first end part 588 of the sub holder 582. The shaft part 584 has a circular hole 587. The circular hole 587 penetrates through the sub holder 582 in the axial direction. The cylindrical shaft 570 of the main holder 542 is to be inserted in the circular hole 587 of the shaft part 584. With this configuration, the sub holder 582 is rotatable about the cylindrical shaft 570 of the main holder 542 with respect to the developing cartridge 500K. To be specific, the sub holder 582 is configured to be pivotally supported by the main holder 542. The sub holder 582 is configured to pivot around the cylindrical shaft 570 extending in the axial direction. In other words, the sub holder 582 is configured to pivot around an axis A3 extending in the axial direction. The axis A3 of the sub holder 582 is an example of a third axis.

2.4.2.2 Protrusion

The protrusion 585 can contact the inclined face 150 (see FIG. 11A) of the connecter 140K when the developing cartridge 500K is attached to the main casing 117 and the top cover 120 is position at the open position. That is, the protrusion 585 is an engaging member configured to engage with an engagement recess 149 (see FIG. 11A) of the connector 140K. The engagement recess 149 is engaged with the protrusion 585 when the top cover 120 moves from the open position to the close position in the state where the process cartridge 300K is attached to the main casing 117. The protrusion 585 is located at one end part of the sub holder 582. That is, the protrusion 585 is located at an upstream end of the sub holder. The protrusion 585 is located on the second outer surface 546. Specifically, the protrusion 585 is exposed to outside through the opening 550 of the main holder 542. The recess 149 is an example of a first recess.

The protrusion 585 protrudes from the opening 550 in the orthogonal direction. The protrusion 585 has an inclined surface 586, which inclines with respect to the moving direction. Specifically, the inclined surface 586 inclines such that a portion of the inclined surface 586 farther from the developing roller 510 in the moving direction is farther from the opening 550 as shown in the FIG. 9. The inclined surface 586 faces, in the moving direction, the inclined surface 150 when the protrusion 585 contacts the inclined surface 150 of the connector 140K. The inclined surface 586 is further inclined, with respect to the moving direction, than the inclined surface 150. That is, when the protrusion 585 contacts the inclined surface 150 of the connector 140K, the inclined surface 586 is spaced from the inclined surface 150 in the opening direction.

The sub holder 582 has the first end part 588 and the second end part 589. The second end part 572 of the main holder 542 and the second end part 589 of the sub holder 582 are spaced in the orthogonal direction. When the sub holder 582 rotates about the cylindrical shaft 570, the distance, in the orthogonal direction, between the second end part 572 of the main holder and the second end part 589 of the sub holder 582 changes. In other words, the sub holder is configured to pivot around the cylindrical shaft 570 extending in the axial direction.

The main holder 542 has the first end part 574 and the second end part 572 which are spaced in the moving direction. The second end part 572 of the main holder 542 is farther from the developing roller 510 than the first end part 574 of the main holder 542 in the moving direction. It is noted that the developing roller 510 is located at one end part of the cartridge casing 520 in the moving direction, and the second end part 572 of the main holder 542 is located at the other end part of the cartridge casing 520 in the moving direction. Further, the developing roller 510 is located at one end part of the cartridge casing 520 in the moving direction, while the second end part 589 of the sub holder 582 is located at the other end part of the cartridge casing 520 in the moving direction.

2.5 IC Chip

The IC chip 590 is a non-transitory recording medium. The IC chip 590 is secured onto the holding surface 575 of the main holder 542. The IC chip 590 is arranged on the first outer surface 544 of the main holder 542. The IC chip 590 is located closer to the developing roller 510 than the third outer surface 549 of the main holder 542 in the moving direction. The IC chip 590 is arranged at a position opposite to the developing roller 510 with respect to the coupling 534 in the moving direction. The IC chip 590 extends in the moving direction. The IC chip 590 has an electrical contact surface 594 on the surface thereof as shown in FIG. 8. The electrical contact surface 594 has multiple memory electrical contacts 592. The memory electrical contacts 592 are, for example, made of conductive metal. The IC chip 590 is an example of a memory. The memory electrical contact 592 is an example of a first electrical contact.

It is noted that, as the recording medium, another recording medium other than the IC chip 590 may be used. The recording medium is only required to store various pieces of information regarding the developing cartridge 500K.

The IC chip 590 stores information regarding the developing cartridge 500K. The information regarding the developing cartridge 500K may include, for example, information regarding the color of developing agent accommodated in the developing cartridge 500K. The information regarding the developing cartridge 500K may include information indicative whether the developing cartridge 500K is a new one or an old one. Alternatively or optionally, the information regarding the developing cartridge 500K may include the number of sheets on which images can be printed with the developing agent stored in the developing cartridge 500K. Specifically, when the IC chip 590 is new, the IC chip 590 stores information indicating that the developing cartridge 500K stores black developing agent, information indicating that the developing cartridge 500K is new, and the number of sheets on which image can be printed with the developing agent accommodated in the developing cartridge 500K is 6000.

2.6 Torsion Spring

The torsion string 596 is supported by the main holder 542. The torsion spring 596 serves as an urging member. The torsion spring 596 is arranged around the shaft part 584 of the sub holder 582. The torsion spring 596 is configured such that one end thereof contacts the main holder 542 and the other end contacts the sub holder 582. With this configuration, the torsion spring 596 urges the sub holder 582 in the orthogonal direction such that the protrusion 585 of the sub holder 582 protrudes from the main holder 542. Thereby, the torsion spring 596 urges the protrusion 585 toward the inclined surface 150 of the connector 140K in the orthogonal direction when the developing cartridge 500K is attached to the main casing 117 and the top cover 120 is positioned at the close position. The torsion spring (596) is positioned between the main holder 542 and the sub holder 582.

The torsion spring 596 is an elastic member and formed by twisting multiple metallic wires. The torsion spring 596 is arranged around the cylindrical shaft 570 of the main holder 542. A length, in the orthogonal direction, between both ends of the torsion spring varies in the third direction such that the length has at least a first condition, and a second condition in which the length is shorter than in the first condition. Thus, the length, in the orthogonal direction, between the second end part 572 of the main holder and the second end part 589 of the sub holder 582 in the first condition is longer than the length, in the orthogonal direction, between the second end part 572 of the main holder 542 and the second end part 589 of the sub holder 582 in the second condition.

Further, the length, in the orthogonal direction, between both ends of the torsion spring 596 in the first condition or the second condition is shorter than the length when the torsion spring 596 is in a neutral state. Therefore, the torsion spring 596 applies an elastic force to the main holder 542 and the sub holder 582 in the orthogonal direction. With this elastic force, the second end part 572 of the main holder 542 and the second end part 589 of the sub holder 582 are urged to separate from each other. In other words, the torsion spring 596 urges the sub holder 582 in a direction away from the main holder 542.

3. Image Forming Apparatus Main Body

The image forming apparatus 1 has multiple connectors 140K, 140Y, 140M and 140C, multiple connector holders 160K, 160Y, 160M and 160C, a main body side spacing member 198, multiple pressing members 170K, 170Y, 170M and 170C (see FIG. 8), second urging members 182K, 182Y, 182M and 182C, a first cam 190, a first urging member 181 and a driving gear train 183.

3.1 Connectors

The connectors 140K, 140Y, 140M and 140C have the same structures, and only the developing cartridges to be respectively connected are different. Therefore, in the following description, only the connector 140K will be described in detail, and description on the same structures regarding the other connectors 140Y, 140M and 140C will be omitted.

The connector 140K is provided to the top cover 120 as shown in FIG. 10. The connector 140K is movable with respect to the top cover 120. The connector 140K serves to electrically connect a circuit board provided to the main casing 117 and the recording medium 41 of the developing cartridge 500K. As shown in FIGS. 11A and 11B, the connector 140K has a first plate 141, a second plate 147, a base 152 and multiple bosses 156. The connector 140K serves as a cap. That is, the connector 140K over-covers the memory holder 540 of the developing cartridge 300K when the developing cartridge 500K is attached to the main body 100 and the top cover is positioned at the close position.

3.1.1 First Plate

The first plate 141 extends in the moving direction. The first plate 141 protrudes downwardly from the base 152 as shown in the FIGS. 11A and 11B. The first plate 141 has a first face 142 which faces the second plate 147 in the orthogonal direction. That is, the connector 140K has the first surface 142. The first surface 142 faces the first outer surface 544 (see FIG. 6) of the main holder 542 in the orthogonal direction when the top cover 120 is positioned at the close position. The first surface 142 of the first plate 141 faces the first outer surface 544 (see FIG. 5) of the main holder 542 of the developing cartridge 300K in the orthogonal direction when the developing cartridge 300K is attached to the main body 100 and the top cover 120 is positioned at the close position. The first plate 141 has two ribs 143 and two guide protrusions 144 as shown in FIGS. 11A and 11B. That is, the connector 140K has two ribs 143. Further, the first plate 141 has two first contact ribs 145A and the two second contact ribs 145B as shown in FIGS. 11A and 11B. That is, the connector 140K has the first contact ribs 145A and the second contact ribs 145B which contact the process cartridge 300K in the axial direction when the process cartridge 300K is attached to the main body 100.

The two ribs 143 are provided to the first surface 142. The two ribs 143 are spaced away from each other in the axial direction. Each of the two ribs 143 protrudes, in the orthogonal direction, from the first surface 142 toward the second face 148. Each of the two ribs 143 extends in the moving direction.

The two guide protrusions 144 are provided on the first surface 142. The two guide protrusions 144 are located on an opposite side to the third plate 152 with respect to the main body electrical contact 154. The two guide protrusions 144 are located at an end part of the first plate 141 in the moving direction. The two guide protrusions 144 are spaced away from each other in the axial direction. In the axial direction, the two ribs 143 are arranged between the two guide protrusions 144. Each of the two guide protrusions 144 protrudes from the first face 142 toward the second plate 147 in the orthogonal direction. Each of the two guide protrusions 144 protrudes, in the orthogonal direction, with respect to the main body electrical contact 154. That is, a protruding length of each of the two guide protrusions 144 is longer than the protruding length of the main body electrical contact 154. In other words, both the guide protrusions 144 have a height larger than a height of the second electrical contact 154. The guide protrusions 144 are arranged on a distal end side, in the moving direction, of the first plate 141 with respect to the main body electrical contact 154. The two guide protrusions 144 are fitted in the groove 552 (see FIG. 6) of the main holder 542. The two guide protrusions 144 are engaged with groove 552 in the state where the process cartridge 300K is attached to the main casing 117 and in the state where the top caver 120 is positioned at the close position.

The two first contact ribs 145A are configured to contact the first guide plate 554 of the developing cartridge 500K (see FIGS. 6 and 8). The two second contact ribs 145B are configured to contact the second guide plate 562 of the developing cartridge 500K (see FIGS. 6 and 8). The contact ribs 145A are guided by the first guide plate 554 when the top cover 120 moves from the open position to the close position in a state where the process cartridge 300K is attached to the main casing 117. The contact ribs 145B are guided by the second guide plate 562 when the top cover 120 moves from the open position to the close position in a state where the process cartridge 300K is attached to the main casing 117.

The first plate 141 has a first end surface 146A and a second end surface 146B as shown in the FIGS. 11A and 11B. The second end surface 146B is opposite from the first end surface 146A in the axial direction. The two first contact ribs 145A are arranged on the first end surface of the first plate 141 in the axial direction. The two first contact ribs 145A protrudes from the first end surface 146A in the axial direction. The two second contact ribs 145B are arranged on the other side face of the first plate 141 in the axial direction. The two second contact ribs 145B protrudes from the second end surface 146B in the axial direction. The two second contact ribs 145B are spaced from the two first contact ribs 145A, respectively, in the axial direction. Further, in the axial direction, the main body electrical contacts 154 are arranged between the two first contact ribs 145A and the two second contact ribs 145B. The first contact rib 145A is an example of a first rib. The second contact rib 145B is an example of a second rib.

The two first contact ribs 145A protrude, in the axial direction, from the first end surface 146A of the first plate 141 as shown in FIG. 11A and FIG. 22. Each of the two first contact ribs 145A extends in the moving direction. The two first contact ribs 145A are arranged next to each other in the orthogonal direction. Further, the two first contact ribs 145A are spaced away from each other in the orthogonal direction. Each of the two first contact rib 145A has a first edge 145A1 at downstream portion. In the closing direction, the first edge 145A1 of each of the two first contact ribs 145A inclines closer to the first end surface 146A of the first plate 141 toward the downstream side. Specifically, the first edge 145A1 has an upstream end 145A1E1 and the downstream end 145A1E2 which is an opposite end, in the closing direction, to the upstream end 145A1E1 as shown in the FIG. 11A. A distance between the downstream end 145A1E2 of the first edge 145A1 and the first end surface 146A of the first plate 141 is smaller than a distance between the upstream end 145A1E1 of the first edge 145A1 and the first end surface 146A of the first plate 141. The upstream end 145A1E1 of the first edge 145A1 is positioned at an upper end of the first edge 145A1. The downstream end 145A1E2 of the first edge 145A1 is positioned at lower end of the first edge 145A1. The upstream end 145A1E1 of the first edge 145A1 is an example of an upper end of the first edge. The downstream end 145A1E2 of the first edge 145A1 is an example of a lower end of the first edge.

The two second contact ribs 145B protrude, in the axial direction, from the second end surface 146B of the first plate 141 as shown in FIG. 11B and FIG. 22. Each of the two second contact ribs 145B extends in the moving direction. The two second contact ribs 145B are arranged next to each other in the orthogonal direction. Further, the two second contact ribs 145B are spaced away from each other in the orthogonal direction. Each of the two second contact rib 145B has a second edge 145B1 at downstream portion. In the closing direction. The second edge 145B1 inclines closer to the second end surface 146B of the first plate 141 toward the downstream side. Specifically, each of the second edges 145B1 has an upstream end 145B 1E1 and the downstream end 145B1E2 which is an opposite end, in the closing direction, to the upstream end 145B1E1 as shown in the FIG. 11B. A distance between the downstream end 145B1E2 of the second edge 145B1 and the second end surface 146B of the first plate 141 is smaller than a distance between the upstream end 145B1E1 of the second edge 145B1 and the second end surface 146B of the first plate 141. The upstream end 145B1E1 of the second edge 145B1 is positioned at an upper end of the second edge 145B1. The downstream end 145B1E2 of the second edge 145B1 is positioned at lower end of the second edge 145B1. The upstream end 145B1E1 of the second edge 145B1 is an example of an upper end of the second edge. The downstream end 145B1E2 of the second edge 145B1 is an example of a lower end of the second edge.

A distance between the upstream end 145A1E1 of the first edge 145A1 and the upstream end 145B1E1 of the second edge 145B1 is larger than a distance between the downstream end 145A1E2 of the first edge 145A1 and the downstream end 145B1E2 of the second edge 145B1 as shown in FIG. 22.

3.1.2 Second Plate

The second plate 147 is spaced away from the first plate 141 in the orthogonal direction. The second plate 147 protrudes downwardly from the base as shown in the FIGS. 11A and 11B. The second plate 147 extends in the moving direction. The second plate 147 has a second surface 148 which faces the first plate 141 in the orthogonal direction. That is, the connector 140K has the second surface 148. The second surface 148 faces the second outer surface 546 of the main holder member 542 in the orthogonal direction when the developing cartridge 500K is attached to the main body 100 and the top cover 120 is located at the close position. The second plate 147 has an engagement recess 149, which has the inclined surface 150. That is, the connector 140K has the inclined surface 150. The engagement recess 149 is an example of a first recess.

The engagement recess 149 engages with the protrusion 585 of the developing cartridge 500K and the top cover 120 moves from the open position to the close position in a state where the process cartridge 300K is attached to the main body 100. When the engagement recess 140 engages with the protrusions 585 of the developing cartridge 500K, the guide protrusions 144 contact the protrusions 585 of the developing cartridge 500K, the engagement recess 149 is formed on the second surface 148. The engagement recess 149 is formed to be recessed in a direction away from the first surface 142 in the orthogonal direction. The engagement recess 149 has the first inclined surface 150. The inclined surface 150 is a part of the second surface 148. The inclined surface 150 is a surface configured to receive the urging force of the torsion spring 596 through the protrusions 585. That is, the second plate 562 receives the urging force of the torsion spring when the developing cartridge 500K is attached to the main body 100 and the top cover 120 is positioned at the close position. The inclined surface 150 is inclined such that a portion thereof closer to the first surface 142 is farther from the third plate 152. Further, the inclined surface 150 is inclined a portion of the top cover 120 on the downstream side, in the closing direction, is closer to the first surface 142. Furthermore, the inclined surface 150 is inclined more, with respect to the orthogonal direction, than the inclined surface 586 (see FIG. 17). The inclined face 150 is directed to the closing direction. The inclined surface 150 is located on the upstream side, in the opening direction, with respect to the third surface 153. In other words, the inclined surface 150 is located on the downstream side with respect to the third surface in the closing direction.

Specifically, the inclined surface 150 has a downstream side end in the moving direction and the other end which is the upstream side end in the closing direction. A distance between one end, in the orthogonal direction, of the inclined surface 150 and the first surface 556 of the first surface 556 of the first plate 141 is shorter than a distance between the other end, in the orthogonal direction, of the inclined surface 150 and the first surface 142 of the first plate 556. Further, the protrusions 585 of the developing cartridge 500K has one end which is on the downstream side in the moving direction, and the other end which is on the upstream side in the moving direction. A distance between the one end of the inclined surface 586 and the first plate 141 when the developing cartridge 500K is attached to the main body 100 and the top cover 120 is positioned at the close position is shorter than a distance between the other end of the inclined surface 586 and the first plate 141 when the developing cartridge 500K is attached to the main body 100 and the top cover 120 is positioned at the close position.

The memory holder 540 is positioned between the first plate 141 and the second plate 147 in a state where the process cartridge 300K is attached to the main casing 117 and in a state where the top cover 120 is positioned at the close position as shown in the FIG. 17.

3.1.3 Base

The base 152 is arranged, in the orthogonal direction, between the first plate 141 and the second plate 147. The base 152 extends in the orthogonal direction. The base 152 is connected to the first plate 141 and the second plate 147. The base 152 has a plate shape. The first plate 141 protrudes downwardly from the base 152 as shown in the FIGS. 11A and 11B. The second plate 147 protrudes downwardly from the base as shown in the FIGS. 11A and 11B. The base 152 has a third surface 153 extending in the orthogonal direction. That is, the connector 140K has a surface which extends in the orthogonal direction. The third surface 153 is arranged, in the orthogonal direction, between the first surface 142 and the second surface 148. The third surface 153 of the base 152 faces the third outer surface 548 (see FIG. 6) of the main holder 542 in the moving direction when the developing cartridge 500K is attached to the main body 100 and the top cover 120 is positioned at the close position. With this configuration, the third surface 153 of the base 152 contacts the third outer surface 548 of the main holder 542 in the moving direction when the developing cartridge 500K is attached to the main body 100, the top cover 120 is positioned at the close position and the connector 140K is pressed by the pressing member 170K.

3.1.4 Main Body Electrical Contacts

The main body electrical contacts 154 are supported by the first plate 141. Specifically, the main body electrical contacts 154 are arranged on the first surface 142, and between the two ribs 143 of the first plate 141. The main body electrical contacts 154 protrude, in the orthogonal direction, from the first face 142 in the same direction in which the two guide protrusions 144 protrude. The main body electrical contacts 154 protrude from the first surface 142 toward the second plate 147. Further, the main body electrical contacts 154 protrude more than the two ribs 143. Each of the main body electrical contacts 154 extends in the moving direction. The main body electrical contacts 154 electrically contacts the memory electrical contacts 592 when the developing cartridge 500K is attached to the main body 100 and the top cover 120 is positioned at the close position. The main body electrical contacts 592 serve, so to speak, as an electrical connector. The main body electrical contacts 154 are positioned between the guide protrusions 144. The main electrical contact 154 is an example of a second electrical contact.

3.1.5 Multiple Bosses

The connector 140K has a boss 156A, a boss 156B, and a boss 156C. The boss 156A protrudes from the outer surface of the connector 140K in the axial direction as shown in the FIG. 11A The boss 156B and the boss 156C protrude from the opposite outer surface of the connector 140K in the axial direction as shown in the FIG. 11B. The boss 156A is inserted into the elongated holes 168A of the connector holder 160K. The boss 156B is inserted into the elongated holes 168B of the connector holder 160K. The boss 156C is inserted into the elongated holes 168C of the connector holder 160K.

3.2 Connector Holders

Connector holders 160K, 160Y, 160M and 160C have the same structure except that the connectors supported thereby are different. Therefore, in the following description, on the connector holder 160K is described in detail, and description on the other connectors 160Y, 160M and 160C regarding the same structures will be omitted.

The connector holder 160K supports the connector 140K. The connector holder 160K is supported by the top cover 120. The connector holder 160K is provided to the top cover 120. Specifically, the top cover 120 has openings 128. The connector holder 160K is inserted in one of the openings 128. With this configuration, the connector 140K is supported by the top cover 120 through the connector holder 160K. The connector holder 160K has a tubular part 162, a protruding part 166 and multiple elongated holes 168.

The tubular part 162 extends in the moving direction. The tubular part 162 has a polygonal tubular shape. Specifically, the tubular part 162 has an opening 164. The opening 164 is formed to penetrate the tubular part 162 in the moving direction. Inside the opening 164, the third plate 152 of the connector 140K is located. The tubular part 162 is inserted through one of the multiple openings 128 (see FIG. 6) of the top cover 120. The tubular part 162 has a clearance, in the axial direction and the moving direction, with an inner circumference of the opening 128. With this configuration, the connector 140K is movable, with respect to the top cover 120, in the axial direction and moving direction.

The protruding part 166 protrudes from the outer circumference of the tubular part 162 in the axial direction and the moving direction. The protruding part 166 contacts an edge of the opening 128 of the top cover 120. With this configuration, the connector holder 160K is supported by the top cover 120.

The connector holder 160K has an elongated hole 168A, an elongated hole 168B, and an elongated hole 168C as shown in the FIGS. 11A and 11B. The three elongated holes 168A, 168B, and 168C are formed on a circumferential wall of the connector holder 160K. The multiple elongated hoes 168A, 168B, and 168C are formed to penetrate through the circumferential wall of the connector holder 160K in the axial direction. The multiple elongated holes 168A, 168B, 168C are formed such that, as shown in FIGS. 11A and 11B, one is formed on one side of the circumferential wall and the other two are formed on the other side of the circumferential wall. The multiple elongated hoes 168 extend in the first direction. The boss 156A is inserted into the elongated holes 168A of the connector holder 160K. The boss 156B is inserted into the elongated holes 168B of the connector holder 160K. The boss 156C is inserted into the elongated holes 168C of the connector holder 160K. Thereby, the connector 140K is movable with respect to the connector holder 160K in the moving direction. In other words, the connector 140K is movable with respect to the top cover 120 in the moving direction.

The LED head 130K is positioned closer to the rotational axis A1 of the top cover 120 than the connector holder 160K is to the rotational axis A1 of the top cove 120 as shown in the FIG. 10. The LED head 130K is positioned closer to the rotational axis A1 of the top cover 120 than the connector 140K is to the rotational axis A1 of the top cove 120 as shown in the FIG. 10.

3.3 Movement of Connectors

As shown in FIGS. 14 and 17, the connectors 140K, 140Y, 140M and 140C are configured to move in association of movement of the top cover 120. It is noted that the close position of the top cover 120 (see FIG. 8) is also a position at which the main body electrical contacts 154 are electrically connected to the memory electrical contacts 592. Further, the open position of the top cover 120 (see FIG. 11) is also a position at which the electrical connection between the main body electrical contacts 154 and the memory electrical contacts 592 is released (i.e., electrically disconnected).

The top cover 120 supports the main body electrical contact 154 via the connector holder 160K and the connector 140K. The main body electrical contact 154 is electrically connected to the memory electrical contact 592 of the IC chip 590 in a state where the process cartridge 300K is attached to the main casing 117 and in a state where the top cover 120 is positioned at the close position.

3.4 Main Body Side Spacing Member

The main body side spacing member 198 is provided to be movable between a contact position (see FIG. 15) where the developing roller 510K contacts the photosensitive drum 710K and a spaced position (see FIG. 16) where the developing roller 510K is spaced from the photosensitive drum 710K, when the developing cartridge 500K is attached to the main body 100 and the top cover 120 is located at the closing position as shown in FIG. 13.

The main body side spacing member 198 is supported by a side wall of the main casing 117. The main body side spacing member 198 is a sliding cam extending in the arrangement direction. The main body side spacing member 198 has multiple gear teeth 199 at one end in the arrangement direction thereof. The multiple gear teeth 199 are arranged along the arrangement direction.

3.5 Pressing Members

As shown in FIGS. 12, 13 and 14, the pressing members 170K, 170Y, 170M and 170C have the same structures. Therefore, in the following description, only the structure of the pressing member 170K will be described, and description on the other pressing members 170Y, 170M and 170C regarding the structure the same as that of the pressing member 170K will be omitted.

The pressing member 170K is a member configured to urge the connector 140K such that the top cover 120 moves in the closing direction. The pressing member 170K is supported by the top cover 120. The pressing member 170K is arranged, in the moving direction, between the connector 140K and the first cam 190. The pressing member 170K is configured to move between a pressure applying position (see FIG. 17) and the pressure releasing position (see FIG. 18). The pressure applying position is a position where the pressing member 170K urges the connector 140K so that the top cover 120 moves in the closing direction. The pressure releasing position is a position where the pressure applied by the pressing member 170K to the connector 140K is released so that the connector 140K becomes movable with respect to the top cover 120 when the top cover 120 is located at the closing position, and the developing cartridge 500K is moved between the contacting position and spaced position by the cartridge side spacing member 720. The pressing member 170K has a rotation shaft 172, a pressing part 174 and a contacting part 176.

3.5.1 Rotation Shaft

The rotation shaft 172 extends in the axial direction as shown in the FIGS. 13 and 14. The rotation shaft 172 is rotatably supported by the tubular part 162 (see FIG. 11A) of the connector holder 160K. That is, the connector holder 160K supports the pressing member 170K. With this configuration, the pressing member 170K is supported by the top cover 120 through the connector holder 160K. Further, the pressing member 170K is movable, about the rotation shaft 172, between the pressure applying position and the pressure releasing position.

3.5.2 Pressing Part

The pressing part 174 extends from the rotation shaft 172 in a radial direction of the rotation shaft 172 as shown in FIGS. 14-19. The pressing part 174 is arranged inside the tubular part 162 of the connector holder 160K. The pressing part 174 faces the third plate 152.

3.5.3 Contacting Part

The contacting part 176 extends, in the radial direction of the rotation shaft 172, from the rotation shaft 172 toward an opposite side to the pressing part 174 as shown in FIG. 14.

As shown in FIG. 17, when the pressing member 170K is located at the pressure applying position, the pressing part 174 contacts the base 152 of the connector 140K and urges the base 152 in a direction where the top cover 120 moves from the opening position to the closing position. With this configuration, when the pressing member 170K is located at the pressure applying position, the pressing member 170K urges the connector 140K so that the top cover 120 moves in the closing direction. It is sufficient that the pressing member 170K presses the connector 140K so that the top cover 120 moves in a direction which includes a component to move the top cover 120 toward the closing direction. For example, the pressing member 170K may urge the connector 140K so that the top cover 120 moves in a direction which is inclined with respect to the closing direction.

As shown in FIG. 18, when the pressing member 170K is located at the pressure releasing position, the pressing part 174 is spaced from the base plate 152 of the connector 140K, thereby pressure having been applied to the connector 140K being released.

When the top cover 120 moves from the closing position to the opening position, the pressing member 170K moves from the pressure releasing position to the pressure applying position. Further, when the top cover 120 is located at the closing position, the pressing member 170K moves from the pressure applying position to the pressure releasing position.

3.6 Second Urging Members

The second urging members 182K, 182Y, 182M and 182C have the same structure as shown in FIG. 12. Therefore, in the following description, only the second urging member 182K will be described, and description on the other second urging members 182K will be omitted.

The second urging member 182K is a member to urge the pressing member 170K to move from the pressure releasing position to the pressure applying position. The second urging member 182K is supported by the connector holder 160K. The second urging member 182K is a coil spring. The second urging member 182K is arranged to surround the rotation shaft 172 of the pressing member 170K. The second urging member 182K is configured such that one end thereof contacts the connector holder 140K, while the other end thereof contacts the pressing member 170K.

3.7 First Cam

The first cam 190 is a member to move each of the pressing members 170K, 170Y, 170M and 170C from the pressure applying position to the pressure releasing position as shown in FIG. 12. The first cam 190 is arranged, in the moving direction, at a position opposite to the connectors 140K, 140Y, 140M and 140C, with respect to the pressing members 170K, 170Y, 170M and 170C. The first cam 190 is supported by the top cover 120. The first cam 190 extends in the arrangement direction. The first cam 190 has, in the moving direction, a first surface 191, a second surface 192, recessed parts 193K, 193Y, 193M and 193C. The first surface 191 faces, in the moving direction, the pressing members 170K, 170Y, 170M and 170C. The second surface 192 is located on an opposite side to the pressing members 170K, 170Y, 170M and 170C with respect to the first surface 191. Each of the recessed parts 193K, 193Y, 193M and 193C is formed to recess, in the moving direction, from the first surface 191 side toward the second surface 192.

The first cam 190 is configured to move, in the arrangement direction, between a first position (see FIG. 15) where the pressing member 170K is located at the pressure applying position and a second position (see FIG. 16) where the pressing member 170K is located at the pressure releasing position. When the first cam 190 is located at the first position, the contacting part 176 of the pressing member 170K is located in the recessed part 193K. The pressing member 170K is located at the pressure applying position by the urging force of the second urging member 182K. That is, the first cam 190 allows the pressing member 170K to be located at the pressure applying position when the first cam 190 is located at the first position. When the first cam 190 is located at the second position, the contacting part 176 of the pressing member 170K contacts the first face 191 of the first cam 190. Then, the pressing member 170K is located at the pressure releasing position against the urging force of the second urging member 182K. That is, the pressing member 170K receives the driving force from the first cam 190 and moves from the pressure applying position to the pressure releasing position. The first cam 190 further has multiple gear teeth 195 (see FIG. 13) and a protruded part 196.

3.7.1 Multiple Gear Teeth

The multiple gear teeth 195 are located at one end of the first cam 190 in the arrangement direction. Further, the multiple gear teeth 195 are formed to be arranged in the arrangement direction.

3.7.2 Protruded Part

The protruded part 196 is located at the other end of the first came 190 in the arrangement direction. Further, the protruded part 196 is formed to protrude from the second surface 192 of the first cam 190 toward a side opposite to the first surface 191.

3.8 First Urging Member

The first urging member 181 is, as shown in FIG. 12, a tension spring. The first urging member 181 is arranged such that one end thereof is hooked on the protruded part 196 and the other end is fixed to the top cover 120. Thus, the first urging member 191 is supported by the top cover 120. With the above configuration, the first urging member 191 urges the first cam 190 to move from the second position toward the first position.

3.9 Driving Gear Train

The driving gear train 183 includes a first gear 184, which engages with the gear teeth 199 of the main body side spacing member 198, a second gear 185, which engages with the gear teeth 195 of the first cam 190, and a gear train 186, which engages with the first gear 184. To the first gear 184, a driving force is input from the driving source 197 in the image forming apparatus 1 as shown in FIG. 13. The gear train 186 includes multiple idle gears 187. The second gear 185 is supported by the top cover 120. The second gear 185 engages with the gear train 186 when the top cover 120 is located at the closing position. With this configuration, the first cam 190 receives the driving force from the gear train 186 when the top cover 120 is located at the closing position. The second gear 185 moves together with the top cover 120 when the top cover 120 moves to the opening position, thereby the second gear 185 being disengaged from the gear train 186. With this configuration, when the top cover 120 is located at the opening position, transmission of the driving force from the gear train 186 to the first cam 190 is released.

The main body side spacing member 198 receives the driving force from the first gear 184 of the gear train 186, and moves among a release position, a color mode position, a monochrome mode position and a fully spaced mode position in this order. The release position is a position at which the developing cartridges 500K, 500Y, 500M and 500C are attached to and/or detached from the main casing 100. The color mode position is a position when the image forming apparatus 1 performs a color printing. The monochrome mode position is a position when the image forming apparatus 1 performs a monochrome printing. The fully spaced position is a position where all the developing rollers 510 are spaced from the photosensitive drums 710, respectively.

The cartridge side spacing member 720 receives the driving force from the main body side spacing member 198, and rotates. Then, as the main holder 542 is urged by the cartridge side spacing member 720, the developing cartridge 500K moves from the contact position (see FIG. 18) to the spaced position (see FIG. 19). Further, when the urging force applied by the cartridge side spacing member 720 to the main holder 542 is released, the developing cartridge 500K is moved from the spaced position (see FIG. 19) to the contact position (see FIG. 18).

4. Connection/Disconnection Between Connector and IC Chip

Referring to FIGS. 14-17 and 22-24, connection and disconnection (release of the connection) between the connector 140 and the IC chip 590 will be described. In the following description, connection between the main body electrical contacts 154 of the connector 140K and the memory electrical contacts 592 of the IC chip 590 will be described in detail.

4.1 Connection Between Connector and IC Chip

As shown in FIG. 13, when the top cover is positioned at the open position, transmission of the driving force from the driving gear train 183 to the first cam 190 is released. Further, as shown in FIG. 14, the first cam 190 is located at the first position by the urging force of the first urging member 181. As shown in FIG. 14, when the top cover 120 is positioned at the open position, the pressing member 170K is located at the pressure applying position by the urging force of the second urging member 182K. With the above configuration, the connector 140K is urged, by the pressing member 170K, in a direction where the top cover 120 moves in the closing direction.

The connector 140K moves, with being urged by the pressing member 170K, in association with movement of the top cover 120 in the closing direction. The connector 140K moves together with the top cover 120. Then, as shown in FIG. 15, the connector 140K contacts the other side of the main holder 542. Specifically, the two guide protrusions 144 of the connector 140K contact the first outer surface 544 of the main holder 542. At this stage, the memory electrical contacts 592 are located, in the axial direction, between the two guide protrusions 144. Further, the main body electrical contacts 154 are spaced, in the orthogonal direction, from the memory electrical contacts 592. Further, the end of the second plate 562 of the connector 140K contacts the protrusions 585 of the sub holder 582.

There could be a case where the connector 140 is located, in the axial direction, at different positions with respect to the second surface 558 of the first guide plate 554, and with respect to the second surface 556 of the second guide plate 562 as shown in FIGS. 22 and 23. Specifically, the connector 140K may be positioned at a position closer to the first guide plate 554, in a space between the second surface 558 of the first guide plate 554 and the second surface 566 of the second guide plate 562. In such a case, the two first contact ribs 145A of the connector 145 contact, in the moving direction, the first surface 556 of the first guide plate 554. Then, the first plate 141 of the connector 140K moves toward the second guide plate 562 as the first plate 141 moves in the moving direction due to inclination of the first surface 556. Then, as shown in FIG. 23, the first plate 141 of the connector 140K is introduced a position between the second surface 558 of the first guide plate 554 and the second surface 566 of the second guide plate 562.

At this stage, the two first contact ribs 145A of the connector 140K face, in the axial direction, the second surface 558 of the first guide plate 554 as shown in FIG. 23. Further, the two second contact ribs 145B of the connector 140K face, in the axial direction, the second surface 556 of the second guide plate 562 as shown in FIG. 23. It is noted that the two first contact ribs 145A may be configured to contact the second surface 558 of the first guide plate 554. The first contact ribs 145A may be slightly spaced from the second surface 558 of the first guide plate 554. Further, the two second contact ribs 145B may be configured to contact the second surface 566 of the second guide plate 562. The second contact ribs 145B may be slightly spaced from the second surface 566 of the second guide plate 562. It is sufficient if the two first contact ribs 145A contact the second surface 558 of the first guide plate 554, or the two second contact ribs 145B contact the second surface 566 of the second guide plate 562.

Thereafter, as the connector 140K further moves in the moving direction, the first plate 141 of the connector 140K moves a space between the second surface 558 of the first guide plate 554 and the second surface 566 of the second guide plate 562 as shown in the FIG. 24.

Next, as shown in FIG. 16, the top cover 120 further moves in the closing direction. At this stage, the end of the second plate 562 of the connector 140K urges the protrusions 585 of the sub holder 582, which is located at the first position, in the orthogonal direction in association with movement of the connector 140K. The sub holder 582 is, as urged by the protrusions 585, retracted in the opening 550 of the main holder 542 against the urging force of the torsion spring 596, and located at the second position. That is, when the top cover 120 moves in the closing direction, the sub holder 582 moves from the first position to the second position as urged by the connector 140K. It is noted that, when the top cover 120 moves in the opening direction, the sub holder 582 is urged by the connecter 140K and moves from the first position to the second position.

Thereafter, the top cover 120 further moves in the closing direction. At this stage, peaks P of the protrusions 585 of the sun holder 582 contact the inclined surface 150 of the second plate 147 (see FIG. 17). That is, when the developing cartridge 500K is attached to the main casing 117 and the top cover 120 is located at the close position, the protrusions 585 of the developing cartridge 500K contact a part of the second face 148.

Then, the protrusions 585 of the sub holder 582 urges the inclined surface 150 by the urging force of the torsion spring 596. Then, as the protrusions 585 push the inclined surface 150, the connector 140K is pulled in a direction where the top cover 120 moves in the opening direction.

When the top cover 120 is located at the closing position as shown in FIG. 17, the third surface 153 of the third plate 152 contacts the third outer surface 548 of the main holder 542. That is, when the protrusions 585 pushes the inclined surface 150, the developing cartridge 500K contacts the third surface 153 of the connecter 140K. At this stage, the two guide protrusions 144 are received by the recess 522 of the main holder 142. Then, as the protrusions 585 push the inclined surface 150, the connector 140K moves in the orthogonal direction. That is, the engagement recess 140 contacts the protrusions 585 and pushed thereby when the top cover 120 is positioned at the close position.

The memory electrical contacts 592 are arranged, in the arrangement direction, between the first plate 141 and the second plate 147. The main body electrical contacts 154 face, in the arrangement direction, the memory electrical contacts 592.

Thus, the main body electrical contact 154 approaches the memory electrical contact 592 in the orthogonal direction and then contacts the same, thereby the main body electrical contact 154 being electrically connected to the memory electrical contact 592. That is, the main body electrical contact 154 is electrically connected to the memory electrical contact 592 when the developing cartridge 500K is attached to the main casing 117 and the top cover 120 is located at the close position. As above, by the urging force of the torsion spring 596, the main body electrical contact 154 is caused to approach the memory electrical contact 592. In other words, the torsion spring 596 generates an urging force which causes the main body electrical contact 154 and the memory electrical contact 592 to approach each other. At this stage, the inclined surface 150 of the developing cartridge 500K faces, in the moving direction, the second inclined surface 586 of the connector 140K.

Further, when the top cover 120 is positioned at the close position, transmission of the driving force between the first cam 190 and the driving gear train 183 (see FIG. 10) become available.

The two ribs 143 (see FIG. 11A) of the connector 140K approaches, in the orthogonal direction, the first outer surface 544 of the developing cartridge 500K and the contact the same when the developing cartridge 500K is attached to the main casing 117 and the top cover 120 moves in the closing direction. That is, the two ribs 143 of the connector 140K contact, in the orthogonal direction, the developing cartridge 500K when the developing cartridge 500K pushes the inclined face 150. The two ribs 143 of the connector 140K contact the developing cartridge 500K in the orthogonal direction when the main body electrical contact 154 and the memory electrical contact 592 are electrically connected. The peaks P (see FIG. 17) of the protrusions 585 are located between both ends E of the rib 143 (see FIG. 17) in a direction where the top cover 120 moves in the closing direction. In other words, contacting portions of the protrusions 585 and the engagement recess 149 are located between the both ends E of the rib 143 in the first direction. With this configuration, the position of the connector 140K is fixed with respect to the end of the main holder 542 in the orthogonal direction as the protrusions 585 contact the inclined face 150, the two ribs 143 contact the first outer surface 544 and the protrusions 585 push the inclined face 150.

Further, when the top cover 120 is positioned at the close position, the protrusions 585 contact the inclined surface 150. Thus, the connector 140K is kept to be pulled in a direction where the top cover 120 moves to the closing direction with the third surface 153 contacting the third outer surface 548 of the main holder 542. That is, the developing cartridge 500K contacts the third surface 548 when the protrusions 585 pushes the inclined surface 150. With this configuration, the connector 140K is fixed with respect to the other end of the main holder 542 in a direction where the top cover 120 moves to the closing direction. Thereafter, the top cover 120 is positioned at the close position.

4.2 Release of Pressure to Connector

After the top cover 120 has been positioned to the close position, as shown in FIG. 18, the first cam 190 moves from the first position to the second position by the driving force from the driving gear train 183 (see FIG. 13). Then, the pressing member 170K moves from the pressure applying position to the pressure releasing position, thereby releasing the pressing force to the connector 140K. Then, the connector 140K becomes movable, in the moving direction, with respect to the top cover 120. Thereafter, at a particular timing (e.g., during image formation operations), the cartridge side spacing member 720 urges, by receiving the driving force from the main body side spacing member 198, the developing cartridge 500K in a direction where the developing roller 510 is separated from the photosensitive drum 710K.

Then, as shown in FIG. 19, the developing cartridge 500K is located to the spaced position by the cartridge side spacing member 720. The developing roller 510 is spaced from the photosensitive drum 710K. At this stage, the connector 140K is urged, by the third outer surface 548 of the first holder member 542, in a direction where the developing roller 510 is spaced from the photosensitive drum 710K. Then, as in the image forming periods, the connector 140K becomes moveable in the moving direction, and is fixed the other end of the main holder 542, the connector 140K moves together with the developing cartridge 500K with the main body electrical contact 154 being electrically connected with the memory electrical contact 592.

As above, the connector 140K moves with the main body electrical contact 154 and the memory electrical contact being electrically connected when the developing cartridge 500K is moved between the contact position and the spaced position by the cartridge side spacing member 720.

4.3 Release of Connection Between Connector and IC Chip

Next, as shown in FIGS. 14 and 17, as the top cover 120 moves from the close position to the open position, the connector 140K moves together with the top cover 120. When the top cover 120 is positioned at the open position, the main body electrical contact 154 is spaced from the memory electrical contact 592 in the moving direction. With this configuration, the electrical connection between the main body electrical contact 154 and the memory electrical contact 592 is released.

When the top cover 120 is moved from the close position to the open position, transmission of the driving force between the first cam 190 and the driving gear train 183 (see FIG. 13) is released.

Then, due to the urging force of the first urging member 181, the first cam 190 is moved from the second position to the first position. Further, the pressing member 170K moves from the pressure releasing position to the pressure applying position due to the urging force of the second urging member 182K. With this configuration, the connector 140K is pressed to move in a direction where the top cover 120 moves to the closing direction by the pressing member 170K.

5. Effects

According to the image forming apparatus 1 described above, as shown in FIG. 17, the connector 140K has the inclined surface 150 which is directed to a direction where the top cover 120 moves to the opening direction. Further, the developing cartridge 500K has protrusions 585 which press the inclined surface 150 by the urging force of the torsion spring 596.

Thus, the connector 140K is kept to be urged in a direction where the top cover 120 moves to the closing direction as the protrusions 585 press the inclined surface 150 when the top cover 120 is positioned at the close position. With this configuration, it is ensured that the connector 140K and the developing cartridge 500K can be fixed with each other. As a result, it becomes possible to move the connector 140K together with the developing cartridge 500K with maintaining a condition where the main body electrical contact 154 is electrically connected with the memory electrical contact 592, thereby frictional deterioration of the main body electrical contact 154 and the memory electrical contact 592 being suppressed.

When the top cover 120 is to be moved to the closing direction, the top cover 120 can be pulled in the direction where the top cover 120 moves to the closing direction when the protrusions 585 contact the inclined face 150. With this configuration, when the top cover 120 is to be moved to the closing direction, it is ensured that the connector 140K and the developing cartridge 500K are fixed to each other.

Further, as shown in FIG. 17, when the top cover 120 is positioned at the close position, the third surface 153 of the connector 140K contacts the third outer surface 548 of the main holder 542. Further, as the protrusions 585 press the inclined surface 150, the connector 140K is kept to be pulled in the direction where the top cover 120 moves to the closing direction. With this configuration, the position of the connector 140K is fixed to the other end of the main holder 542, in the direction where the top cover 120 moves to the closing direction. As a result, it is ensured that the connector 140K can be moved together with the developing cartridge 500K with the main body electrical contact 154 being electrically connected to the memory electrical contact 592.

Further, as shown in FIG. 17, when the top cover 120 is positioned at the close position, the second inclined faces 586 of the protrusions 585 face the inclined surface 150 in the moving direction. Therefore, by the contact between the protrusions 585 and the inclined surface 150, it is ensured that the connector 140K can be moved together with the developing cartridge 500K.

According to the image forming apparatus 1, as shown in FIG. 17, the developing cartridge 500K has the protrusions 585 which protrude in the orthogonal direction. Further, the connector 140K has the engagement recess 149 to which the protrusions 585 contact. The developing cartridge 500K is configured to be moved, in the moving direction which intersects with the orthogonal direction, from the contact position to the spaced position by the cartridge side spacing member 620.

Therefore, when the developing cartridge 500K is to be moved in the moving direction, since the protrusions 585 contact the engagement recess 149, the connector 140K can be moved together with the developing cartridge 500K. As a result, it is possible to move the connector 140K together with the developing cartridge 500K with the main body electrical contact 154 being electrically connected to the memory electrical contact 592, thereby frictional deterioration of the main body electrical contact 154 and the memory electrical contact 592 being suppressed.

Further, as shown in FIG. 14, when the top cover 120 is moved in the closing direction, or in the opening direction, the sub holder 582 having the protrusions 585 moves, against the urging force of the torsion spring 596, from the first position to the second position, and is retracted in the opening 550. Therefore, in a configuration where the developing cartridge 500K has the protrusions 595, the connector 140K can be smoothly moved between the open position and the close position.

According to the image forming apparatus 1 described above, as shown in FIG. 17, the connector 140K is always urged in the direction where the main body electrical contact 154 contacts the memory electrical contact 592 as the protrusions 585 urged by the torsion spring 596 of the developing cartridge 500K pushes the first inclined face 150 with the top cover 120 being located at the closing position. Therefore, it is ensured that the protrusions 585 are engaged with the engagement recess 149 with the urging force of the torsion spring 596, and the main body electrical contact 154 contacts the memory electrical contact 592.

Specifically, the position of the connector 140K is fixed, in the orthogonal direction, with the end part of the main holder 542 as the protrusions 585 contact the first inclined surface 150, the two ribs 143 contact the first outer surface 544, and the protrusions 585 pushes the first inclined surface 150. As a result, it is possible to move the connector 140K together with the developing cartridge 500K with the main body electrical contact 154 being electrically connected to the memory electrical contact 592, thereby frictional deterioration of the main body electrical contact 154 and the memory electrical contact 592 being suppressed.

When the top cover 120 is positioned at the close position, the third surface 153 of the connector 140K contacts the third outer surface 548 of the main holder 542. Further, as the protrusions 585 pushes the first inclined surface 150, the connector 140K is always pulled in the direction where the top cover 120 moves in the closing direction. With the above configuration, the position of the connector 140K is fixed, in the direction where the top cover 120 moves in the closing direction, to the end part of the main holder 542. As a result, it is ensured that the connector 140K can be moved together with the developing cartridge 500K with maintaining the condition where the main body electrical contact 154 is electrically connected to the memory electrical contact 592.

The image forming apparatus 100 according to the illustrative embodiment is configured, as shown in FIGS. 14 and 17 such that the top cover 120 is moved in the closing direction with the connector 140K being urged to the closing direction of the top cover 120 with the pressing member 170K.

Therefore, movement of the connector 140K in the closing direction of the top cover 120 may be suppressed with the pressing member 170K.

As a result, when the main body electrical contact 154 and the memory electrical contact 592 are electrically connected, by suppressing the movement of the connector 140K, the electrical connection therebetween.

Further, as shown in FIG. 18, the pressing member 170K moves to the pressure releasing position after the top cover 120 moves to the close position, thereby releasing the pressure to the connector 140K. With this configuration, as shown in FIG. 19, the connector 140K becomes movable together with the developing cartridge 500K. Thus, frictional deterioration of the main body electrical contact 154 and the memory electrical contact 592 can be suppressed.

Further, the connector 140K contacts the third outer surface 548 of the main holder 542 on the surface 153 of the base 152 when the top cover 120 is located at the close position. Thus, the connector 140K becomes movable together with the developing cartridge 500K as pushed by the third outer surface 548 of the gear cover (i.e., the main holder 542).

As shown in FIGS. 14 and 17, when the top cover 120 moves to the open position, the first cam 190 releases transmission of the driving force with respect to the driving gear train 183, and moves from the second position to the first position by the urging force of the first urging member 181. Thus, when the top cover 120 is located at the opening position, it is ensured that the first com 190 is located at the first position, and the pressing member 170K is located at the pressure applying position.

According to the image forming apparatus 100 described above, as shown in FIGS. 3 and 10, each of the multiple connectors 140K, 140Y, 140M and 140C can be electrically connected to the circuit board 123 through the electrical wiring. Therefore, with the circuit board 123, wired control of the multiple connectors 140K, 140Y, 140M and 140C can be executed. As a result, it is ensured that the circuit board 23 read/overwrite information stored in multiple cartridges, respectively.

According to the image forming apparatus 100 described above, as shown in FIGS. 22 and 23, when the top cover 120 is to be located to the close position, the position of the connector 140K, in the axial direction, can be compensated by contact between the two first contact ribs 145A of the connector 140K and the first guide plate 554 of the developing cartridge 500K, or contact between the two second contact ribs 145B of the connector 140K and the second guide plate 562 of the developing cartridge 500K. As a result, it is ensured that the main body electrical contact 154 is located at a position facing the memory electrical contact 592.

As shown in FIG. 20, the first guide plate 554 has the first surface 556 at the upstream end part in the closing direction, and the second guide plate 562 has the first surface 564 at the upstream end part in the closing direction. Each of the first surface 556 and the first surface 564 are inclined such that a portion on the face on more downstream side, in the closing direction, is closer to the IC chip 590.

With this configuration, as shown in FIGS. 22 and 23, in association with movement of the connector 140K in the moving direction, the position of the connector 140K in the axial direction can be compensated smoothly.

As shown in FIG. 21, the first guide plate 554 has the inclined surface 560 at the tip thereof in a direction where the first guide plate 554 protrudes, and the second guide plate 562 has the inclined face 568 at the tip thereof in the direction where the first guide plate 554 protrudes. The inclined surface 560 and the inclined face 568 are inclined such that a portion closer to the outer surface 544 is closer to the IC chip 590.

With the above configuration, even if the connector 140K moves, with forming an arc-like locus in association with the rotational movement of the top cover 120, and contacts the first guide plate 554 or the second guide plate 562 from the tip end side in which the first guide plate 554 and the second guide plate 562 protrude, the position of the connector 140K in the axial direction can be compensated.

First Modification

In the illustrative embodiment described above, the sub holder 582 is urged by the torsion spring 596. This configuration can be modified such that, for example, a plate 81 extending in the moving direction is provided in the opening 550 of the main holder 542, and the protrusion 585 may be provided to the plate 81 as shown in FIGS. 25A and 25B. In this modification, one end, in the moving direction, of the plate 81 is continued to the main holder 542, and a peripheral part other than the one end of the plate 81 has a clearance with the inner surface of the opening 550. With this configuration, the plate 81 can be elastically deformable in the orthogonal direction. In such a configuration, when the plate 81 is elastically deformed, the protrusion 585 engages with the engagement recess 140 of the connector 140K (see FIG. 11A) when the developing cartridge 300K is attached to the main body 100 and the top cover 120 is positioned at the close position.

Second Modification

FIG. 26 shows a second modification of the illustrative embodiment described above. The second modification is different from the above-described illustrative embodiment in that the memory holder 540 does not have the protrusions 585. That is, the sub holder 582 according to the second modification does not have the protrusion 585. The memory holder 540 according to the second modification has, similar to the illustrative embodiment, the main holder 542, the sub holder 582, and the torsion spring 596.

The main holder 542 has, similar to the illustrative embodiment, the first outer surface 544, the second outer surface 546, the third outer surface 548, the opening 550, the groove 552, and the cylindrical shaft 570. The main holder 542 has the first end part 574 and the second end part 572. The main holder 542 has the first guide plate 554 and the second guide plate 562. Further, the first outer surface 544 of the main holder 542 has the holding surface 575. On the holding surface 575 of the main holder 542, the IC chip 590 is held.

The sub holder 582 has, similar to the illustrative embodiment, the shaft part 584 having the circular hole 587, and is configured to rotate, with respect to the developing cartridge 500K, about the cylindrical shaft 570. The sub holder 582 has the first end part 588 and the second end part 589.

Next, the electrical connection between the connector 140 and the IC chip 590 will be described, referring to FIGS. 27-30.

As shown in FIG. 30, after the drum cartridge 700K in which the developing cartridge 500K is attached is inserted in the main body 100, the connector 140K approaches the memory holder 540 in association with closing movement of the top cover 120. At this stage, the first guide plate 554 and the second guide plate 562 guide, in the moving direction, the memory holder 540. Specifically, the first guide plate 542 and the second guide plate 562 guide, in the moving direction, the memory holder 540 from the second end part 572 to the IC chip 590. As a result, the first guide plate 542 and the second guide plate 562 guide, in the second direction, the main body electrical contact 154 from the second end part 572 to the IC chip 590. At that stage, the first guide plate 554 and the second guide plate 562 position the main body electrical contact 154 in the first direction. Then, as shown in FIG. 28, the first plate 141 and the second plate 147 contact the memory holder 540. Specifically, the guide protrusion 144 of the first plate 554 contacts the second end part 572 of the main holder 542. Then, the second plate 147 contacts the second end part 589 of the sub holder 582.

At this stage, the guide protrusion 144 of the first plate 554 is arranged at a position different from the IC chip 590 in the first direction. Accordingly, the guide protrusion 144 does not contact the IC chip 590, but only contacts the surface of the main holder 542. Therefore, guide protrusion 144 is prevented from frictionally scraping the memory electrical contact 592 of the IC chip 590.

When the connector 140K is further push-inserted in the moving direction, as indicated by arrowed-broken lines in FIG. 29, the second plate 147 urges the second end part 589 of the sub holder 582 toward the second end part 572 of the main holder 542. Then, the length between both ends, in the second direction, of the torsion spring 596 gradually decreases, from a first state to a second state. Thus, the sub holder 582 rotates about the cylindrical shaft 570. As a result, a distance, in the intersecting direction, between the second end part 572 of the main holder 542 and the second end part 589 of the sub holder 582 decreases. The position of the holding surface 575 with respect to the second end part 589 of the memory holder 540 changes, in the intersecting direction, from an initial position (i.e., a first position) to an intermediate position (i.e., a second position).

Thereafter, as the connector 140K is further pushed in the moving direction, the guide protrusion 144 of the first plate 554 is engaged in the groove 552 of the main holder 542, as shown in FIG. 30. Then, the distance, in the second direction, between both ends of the torsion spring 596 becomes in a third state corresponding to the shorter than the first state and longer than the second state. The sub holder 582 pushes the second plate 147 in the third direction with the elastic force of the torsion spring 596. As a result, the main body electrical contact 154 contacts the memory electrical contact 592 of the IC chip 590. That is, the memory holder 540 moves the main body electrical contact 154 toward the memory electrical contact 592 with the elastic force of the torsion spring 596. Further, as the guide protrusion 144 engages with the groove 552, removal of the memory holder 540 from the connector 140K in the moving direction. At this stage, the position of the holding surface 575 with respect to the second part 589 of the memory holder 540 moves, in the intersection direction, from the intermediate position (i.e., the second position) to the contact position (i.e., the third position).

With the above movement, the connecter 140K covers over the memory holder 540. The memory electrical contact 592 and the main body electrical contact 154 push each other with the elastic force of the torsion spring 596, thereby the electrical connection between the memory electrical contact 592 and the main body electrical contact 154 being maintained.

As above, even though an appropriate contact pressure is applied from the memory electrical contact 592 of the developing cartridge 500K to the main body electrical contact 154 of the main body 100 with an elastic member (e.g., the torsion spring 596), the main body electrical contact 154 is appropriately guided and positioned to the memory electrical contact 592 by the first guide plate 554 and the second guide plate 562.

Further, when the connector 140K is caused to cover over the memory holder 540, the position of a holding surface 576 with respect to the second end part 589 of the memory holder 540 can be changed in the orthogonal direction. Therefore, the connector 140K can be moved in the moving direction with the position, in the orthogonal direction, of the holding surface 576 with respect to the second end part 589 being changed along the guide protrusion 144. In comparison with a case where the connector 140K is covered over the memory holder 540 with the position of the holding surface 576, in the orthogonal direction, with respect to the second end part 589 being fixed, the pressure, in the orthogonal direction, applied from the guide protrusion 144 to the main holder 542 is reduced.

The memory electrical contact 592 of the IC chip 590 is arranged at a position which is recessed with respect to the surface of the main holder 542. Thus, the peak of the guide protrusion 144 only contacts the surface of the main holder 542 and does not contact the memory electrical contact 592. According to the above configuration, the guide protrusion 144 is prevented from frictionally scraped by the memory electrical contact 592.

Further, as shown in FIG. 30, since the guide protrusion 144 engages with the groove 552, the memory electrical contact 592 directly contacts the main body electrical contact 154. With this configuration, frictional scraping of the main body electrical contact 154 can be reduced.

In the above-described embodiment, the IC chip 590 having the memory electrical contact 592 is fixed on the outer surface of the memory holder 540. Such an embodiment can be modified such that only the memory electrical contact 592 contacting the electrical connector 154 is fixed on the outer face of the memory holder 540, and portions other than the memory electrical contact 592 of the IC chip 590 may be arranged at another portion of the developing cartridge 500K.

Other Modifications

Further, in the above-described embodiment, the multiple gears 532 are engaged with each other through the teeth thereof. Such a configuration may be modified such that the multiple gear 532 may engage with each other with a frictional force. For example, on outer circumferential surfaces of two gears to engage with each other, frictional members (e.g., rubber) may be provided instead of the gear teeth.

Further, according to the above-described embodiment, the developing cartridge 500K is provided with the torsion spring 596. It is noted that, instead of the torsion spring 596, a coil spring may be used. Alternatively, a plate spring may be used instead of the torsion spring 596. It is also noted that, instead of the torsion spring 596, an elastic member made of elastic material may be used.

In the above-described embodiment, the circuit boar 123 has the first circuit 124 to which the multiple connectors are electrically connected, the second circuit 125 to which multiple LED heads 130K, 130Y, 130M and 130C are electrically connected, and the third circuit 126 to which the input device 122 is electrically connected. It is noted that, to the circuit board 123, multiple connectors 140K, 140Y, 140M and 140C may be electrically connected. In such case, the main body 100 may optionally have a circuit board to which the multiple LED heads 130K, 130Y, 130M and 130C are electrically connected, and another circuit board to which the input device 122 is electrically connected.

Further, according to the illustrative embodiment, the cartridge having the developing rollers 510 is described as an example of the cartridge. Such an embodiment may be modified such that the cartridge may be a toner cartridge which contains developing agent, and does not have the developing roller 510. Alternatively, the cartridge may be a process cartridge which has the developing rollers 510 and the photosensitive drums 710.

It is noted that the developing cartridge 500K described above is to be attached with respect to the drum cartridge 700K. However, the developing cartridge 500K may be one to be attached with respect to a drawer unit provided to the image forming apparatus 1. Further, the developing cartridge 500K may be attached to the main body 100 of the image forming apparatus 1 which does not have the drawer unit.

What is claimed is:

1. An image forming apparatus comprising:

a main casing including an opening, the opening being provided at an upper portion of the main casing;

a process cartridge including a photosensitive drum, the process cartridge being attachable to the main casing through the opening, the process cartridge including a memory including a first electrical contact;

a top cover movable between an open position where the top cover opens the opening and a close position where the top cover closes the opening, the top cover supporting an LED head configured to emit light to expose the photosensitive drum, the top cover supporting a second electrical contact, the second electrical contact being electrically connected to the first electrical contact of the memory in a state where the process cartridge is attached to the main casing and in a state where the top cover is positioned at the close position;

a connector supporting the second electrical contact, the connector being movable with respect to the top cover; and a connector holder provided to the top cover, the connector holder including an elongated hole, wherein the top cover is movable between the open position and the close position around a first axis extending in an axial direction, and wherein the connector includes a boss protruding in the axial direction, the boss being inserted into the elongated hole of the connector holder.

2. The image forming apparatus according to claim 1, wherein the LED head is movable around a second axis extending in the axial direction with respect to the top cover.

3. The image forming apparatus according to claim 1, wherein the LED head is positioned closer to the first axis of the top cover than the connector holder is to the first axis.

4. The image forming apparatus according to claim 2, wherein the connector includes:

a base;

a first plate protruding downwardly from the base of the connector; and a second plate protruding downwardly from the base of the connector, the second plate being spaced away from the first plate; and wherein the process cartridge includes a memory holder supporting the memory, the memory holder being positioned between the first plate of the connector and the second plate of the connector in the state where the process cartridge is attached to the main casing and in the state where the top cover is positioned at the close position.

5. The image forming apparatus according to claim 4, wherein the first plate of the connector includes a surface facing the second plate of the connector, and wherein the second electrical contact is provided on the surface of the first plate.

6. The image forming apparatus according to claim 4, wherein the memory holder includes a main holder and a sub holder movable with respect to the main holder, the sub holder including a protrusion, and wherein the second plate includes a first recess being engaged with the protrusion of the sub holder when the top cover moves from the open position to the close position in the state where the process cartridge is attached to the main casing.

7. The image forming apparatus according to claim 6, wherein the sub holder is pivotally supported by the main holder, the sub holder being configured to pivot around a third axis extending in the axial direction in the state where the process cartridge is attached to the main casing.

8. The image forming apparatus according to claim 7, further comprising a spring positioned between the main holder and the sub holder, the spring urging the sub holder toward a direction away from the main holder.

9. The image forming apparatus according to claim 8,
wherein the main holder includes a first surface facing the sub holder and a second surface opposite from the first surface, and
wherein the memory is provided on the second surface of the main holder.

10. The image forming apparatus according to claim 4,
wherein the memory holder includes:
a first guide plate; and
a second guide plate spaced away from the first guide plate in the axial direction in the state where the process cartridge is attached to the main casing, the memory being positioned between the first guide plate and the second guide plate,
wherein the connector includes:
a first end surface;
a first rib protruding from the first end surface;
a second end surface opposite from the first end surface in the axial direction; and
a second rib protruding from the second end surface,
wherein the first guide plate guides the first rib when the top cover moves from the open position to the close position in the state where the process cartridge is attached to the main casing, and
wherein the second guide plate guides the second rib when the top cover moves from the open position to the close position in the state where the process cartridge is attached to the main casing.

11. The image forming apparatus according to claim 10,
wherein the first guide plate includes a first guide surface facing the second guide plate,
wherein the second guide plate includes a second guide surface facing the first guide surface of the first guide plate, and
wherein a distance between an upper end of the first guide surface and an upper end of the second guide surface is larger than a distance between a lower end of the first guide surface and a lower end of the second guide surface.

12. The image forming apparatus according to claim 10,
wherein the first rib includes a first edge in the axial direction,
wherein the second rib includes a second edge in the axial direction, and
wherein a distance between an upper end of the first edge and an upper end of the second edge is larger than a distance between a lower end of the first edge and a lower end of the second edge.

13. The image forming apparatus according to claim 5,
wherein the first plate includes a guide protrusion protruding from the surface of the first plate, the guide protrusion having a height larger than a height of the second electrical contact, and
wherein the memory holder includes a second recess positioned lower than the memory in the state where the process cartridge is attached to the main casing, the second recess being engaged with the guide protrusion in the state where the process cartridge is attached to the main casing and in the state where the top cover is positioned at the close position.

14. The image forming apparatus according to claim 13,
wherein the first plate includes another guide protrusion protruding from the surface of the first plate, the other guide protrusion having a height larger than the height of the second electrical contact,
wherein the second recess is engaged with the other guide protrusion in the state where the process cartridge is attached to the main casing and in the state where the top cover is positioned at the close position, and
wherein the second electrical contact is positioned between the guide protrusion and the other guide protrusion.

15. The image forming apparatus according to claim 4,
wherein the process cartridge includes:
a drum cartridge including the photosensitive drum, and
a developing cartridge attachable to the drum cartridge, the developing cartridge including a developing roller,
wherein the developing cartridge includes a cartridge casing accommodating toner and a gear configured to transmit a driving force to the developing roller, and
wherein the gear is positioned between the cartridge casing and the memory holder.

16. The image forming apparatus according to claim 1, further comprising a circuit board supported by the top cover, the circuit board being electrically connected to the second electrical contact.

17. The image forming apparatus according to claim 16, wherein the circuit board is electrically connected to the LED head.

* * * * *